US010566703B2

(12) United States Patent
Fox et al.

(10) Patent No.: US 10,566,703 B2
(45) Date of Patent: Feb. 18, 2020

(54) EFFICIENT PLANAR PHASED ARRAY ANTENNA ASSEMBLY

(71) Applicants: Urthecast Corp, Vancouver (CA); King Abdulaziz City of Science and Technology, Riyadh (SA)

(72) Inventors: Peter Allen Fox, Burnaby (CA); Abhijit Bhattacharya, Burnaby (CA); Ying Chen, Richmond (CA); Rodney Grant Vaughan, Burnaby (CA)

( * ) Notice: Subject to any disclaimer, the term of this patent is extended or adjusted under 35 U.S.C. 154(b) by 166 days.

(21) Appl. No.: 15/737,065

(22) PCT Filed: Jun. 15, 2016

(86) PCT No.: PCT/US2016/037666
§ 371 (c)(1),
(2) Date: Dec. 15, 2017

(87) PCT Pub. No.: WO2017/044168
PCT Pub. Date: Mar. 16, 2017

(65) Prior Publication Data

US 2018/0366837 A1 Dec. 20, 2018

Related U.S. Application Data

(60) Provisional application No. 62/180,421, filed on Jun. 16, 2015.

(51) Int. Cl.
*H01Q 13/10* (2006.01)
*H01Q 21/06* (2006.01)
(Continued)

(52) U.S. Cl.
CPC ..... *H01Q 21/064* (2013.01); *H01Q 5/42* (2015.01); *H01Q 13/18* (2013.01); *H01Q 21/005* (2013.01); *H01Q 21/30* (2013.01)

(58) Field of Classification Search
None
See application file for complete search history.

(56) References Cited

U.S. PATENT DOCUMENTS 3,193,830 A 7/1965 Provencher
3,241,140 A 3/1966 Raabe
(Continued)

FOREIGN PATENT DOCUMENTS

CA 2428513 C 7/2003
CA 2488909 C 5/2005
(Continued)

OTHER PUBLICATIONS

Partial Supplementary Search Report issued in European Application No. 15829734.1, dated Dec. 21, 2017, 16 pages.
(Continued)

*Primary Examiner* — Trinh V Dinh
(74) *Attorney, Agent, or Firm* — Grossman, Tucker, Perreault & Pfleger, PLLC

(57) ABSTRACT

A planar phased array antenna assembly includes a first face sheet with a first plurality of radiating slots for a first frequency band and a second plurality of radiating slots for a second frequency band, a second face sheet, a third face sheet, and a structure interposed between the first and second face sheets with a third plurality of radiating elements at the first frequency band and a fourth plurality of radiating elements at the second frequency band, and a first feed network for the third plurality of radiating elements and a second feed network for the fourth plurality of radiating elements, and the second face sheet interposed between the structure and the third face sheet. The planar phased array antenna assembly may form part of a synthetic aperture radar (SAR) antenna.

24 Claims, 14 Drawing Sheets

(51) Int. Cl.

| | |
|---|---|
| ***H01Q 21/30*** | (2006.01) |
| ***H01Q 5/42*** | (2015.01) |
| ***H01Q 13/18*** | (2006.01) |
| ***H01Q 21/00*** | (2006.01) |

(56) References Cited

U.S. PATENT DOCUMENTS 3,460,139 A 8/1969 Rittenbach
3,601,529 A 8/1971 Dischert
3,715,962 A 2/1973 Yost, Jr.
3,808,357 A 4/1974 Nakagaki et al.
4,163,247 A 7/1979 Bock et al.
4,214,264 A 7/1980 Hayward et al.
4,246,598 A 1/1981 Bock et al.
4,404,586 A 9/1983 Tabei
4,514,755 A 4/1985 Tabei
4,656,508 A 4/1987 Yokota
4,803,645 A 2/1989 Ohtomo et al.
4,823,186 A 4/1989 Muramatsu
4,924,229 A 5/1990 Eichel et al.
4,951,136 A 8/1990 Drescher et al.
5,057,843 A 10/1991 Dubois et al.
5,059,966 A 10/1991 Fujisaka et al.
5,093,663 A 3/1992 Baechtiger et al.
5,173,949 A 12/1992 Peregrim et al.
5,248,979 A 9/1993 Orme et al.
5,313,210 A 5/1994 Gail
5,486,830 A 1/1996 Axline, Jr. et al.
5,489,907 A 2/1996 Zink et al.
5,512,899 A 4/1996 Osawa et al.
5,546,091 A 8/1996 Haugen et al.
5,552,787 A 9/1996 Schuler et al.
5,646,623 A 7/1997 Walters et al.
5,745,069 A 4/1998 Gail
5,760,899 A 6/1998 Eismann
5,790,188 A 8/1998 Sun
5,821,895 A 10/1998 Hounam et al.
5,883,584 A 3/1999 Langemann et al.
5,926,125 A 7/1999 Wood
5,945,940 A 8/1999 Cuomo
5,949,914 A 9/1999 Yuen
5,952,971 A 9/1999 Strickland
5,973,634 A 10/1999 Kare
6,007,027 A 12/1999 Diekelman et al.
6,122,404 A 9/2000 Barter et al.
6,241,192 B1 6/2001 Kondo et al.
6,259,396 B1 7/2001 Pham et al.
6,347,762 B1 2/2002 Sims et al.
6,359,584 B1 3/2002 Cordey et al.
6,502,790 B1 1/2003 Murphy
6,577,266 B1 6/2003 Axline
6,614,813 B1 9/2003 Dudley et al.
6,633,253 B2 10/2003 Cataldo
6,678,048 B1 1/2004 Rienstra et al.
6,741,250 B1 5/2004 Furlan et al.
6,781,540 B1 8/2004 MacKey et al.
6,781,707 B2 8/2004 Peters et al.
6,831,688 B2 12/2004 Lareau et al.
6,861,996 B2 * 3/2005 Jeong ..... H01Q 1/523 29/600
6,864,827 B1 3/2005 Tise et al.
6,914,553 B1 7/2005 Beadle et al.
6,919,839 B1 7/2005 Beadle et al.
6,970,142 B1 11/2005 Pleva et al.
7,015,855 B1 3/2006 Medl et al.
7,019,777 B2 3/2006 Sun
7,034,746 B1 4/2006 McMakin et al.
7,064,702 B1 6/2006 Abatzoglou
7,095,359 B2 8/2006 Matsuoka et al.
7,123,169 B2 10/2006 Farmer et al.
7,149,366 B1 12/2006 Sun
7,158,878 B2 1/2007 Rasmussen et al.
7,167,280 B2 1/2007 Bogdanowicz et al.
7,212,149 B2 5/2007 Abatzoglou et al.
7,218,268 B2 5/2007 VandenBerg
7,242,342 B2 7/2007 Wu et al.
7,270,299 B1 9/2007 Murphy
7,292,723 B2 11/2007 Tedesco et al.
7,298,922 B1 11/2007 Lindgren et al.
7,327,305 B2 2/2008 Loehner et al.
7,348,917 B2 3/2008 Stankwitz et al.
7,379,612 B2 5/2008 Milanfar et al.
7,385,705 B1 6/2008 Hoctor et al.
7,412,107 B2 8/2008 Milanfar et al.
7,414,706 B2 8/2008 Nichols et al.
7,417,210 B2 8/2008 Ax, Jr. et al.
7,423,577 B1 9/2008 McIntire et al.
7,468,504 B2 12/2008 Halvis et al.
7,475,054 B2 1/2009 Hearing et al.
7,477,802 B2 1/2009 Milanfar et al.
7,486,221 B2 2/2009 Meyers et al.
7,536,365 B2 5/2009 Aboutalib
7,545,309 B1 6/2009 McIntire et al.
7,548,185 B2 6/2009 Sheen et al.
7,570,202 B2 8/2009 Raney
7,599,790 B2 10/2009 Rasmussen et al.
7,602,997 B2 10/2009 Young
7,623,064 B2 11/2009 Calderbank et al.
7,646,326 B2 1/2010 Antonik et al.
7,698,668 B2 4/2010 Balasubramanian et al.
7,705,766 B2 4/2010 Lancashire et al.
7,733,961 B2 6/2010 O'Hara et al.
7,746,267 B2 6/2010 Raney
7,769,229 B2 8/2010 O'Brien et al.
7,769,241 B2 8/2010 Adams, Jr. et al.
7,781,716 B2 8/2010 Anderson et al.
7,825,847 B2 11/2010 Fujimura
7,830,430 B2 11/2010 Adams, Jr. et al.
7,844,127 B2 11/2010 Adams, Jr. et al.
7,855,740 B2 12/2010 Hamilton, Jr. et al.
7,855,752 B2 12/2010 Baker et al.
7,876,257 B2 1/2011 Vetro et al.
7,884,752 B2 2/2011 Hellsten et al.
7,897,902 B2 3/2011 Katzir et al.
7,911,372 B2 3/2011 Nelson
7,924,210 B2 4/2011 Johnson
7,936,949 B2 5/2011 Riley et al.
7,940,282 B2 5/2011 Milanfar et al.
7,940,959 B2 5/2011 Rubenstein
7,991,226 B2 8/2011 Schultz et al.
8,013,778 B2 9/2011 Grafmueller et al.
8,031,258 B2 10/2011 Enge et al.
8,040,273 B2 10/2011 Tomich et al.
8,045,024 B2 10/2011 Kumar et al.
8,049,657 B2 11/2011 Prats et al.
8,053,720 B2 11/2011 Han et al.
8,059,023 B2 11/2011 Richard
8,068,153 B2 11/2011 Kumar et al.
8,073,246 B2 12/2011 Adams, Jr. et al.
8,078,009 B2 12/2011 Riley et al.
8,090,312 B2 1/2012 Robinson
8,094,960 B2 1/2012 Riley et al.
8,111,307 B2 2/2012 Deever et al.
8,115,666 B2 2/2012 Moussally et al.
8,116,576 B2 2/2012 Kondo
8,125,370 B1 2/2012 Rogers et al.
8,125,546 B2 2/2012 Adams, Jr. et al.
8,134,490 B2 3/2012 Gebert et al.
8,138,961 B2 3/2012 Deshpande
8,169,358 B1 5/2012 Bourdelais et al.
8,169,362 B2 5/2012 Cook et al.
8,179,445 B2 5/2012 Hao
8,180,851 B1 5/2012 Cavelie
8,194,296 B2 6/2012 Compton et al.
8,203,615 B2 6/2012 Wang et al.
8,203,633 B2 6/2012 Adams, Jr. et al.
8,204,966 B1 6/2012 Mendis et al.
8,212,711 B1 7/2012 Schultz et al.
8,274,422 B1 9/2012 Smith et al.
8,299,959 B2 10/2012 Vossiek et al.
8,358,359 B2 1/2013 Baker et al.
8,362,944 B2 1/2013 Lancashire
8,384,583 B2 2/2013 Leva et al.
8,411,146 B2 4/2013 Twede

(56) References Cited

U.S. PATENT DOCUMENTS 8,441,393 B2 5/2013 Strauch et al.
8,482,452 B2 7/2013 Chambers et al.
8,487,996 B2 7/2013 Mann et al.
8,493,262 B2 7/2013 Boufounos et al.
8,493,264 B2 7/2013 Sasakawa
8,502,730 B2 8/2013 Roche
8,532,958 B2 9/2013 Ingram et al.
8,543,255 B2 9/2013 Wood et al.
8,558,735 B2 10/2013 Bachmann et al.
8,576,111 B2 11/2013 Smith et al.
8,594,375 B1 11/2013 Padwick
8,610,771 B2 12/2013 Leung et al.
8,698,668 B2 4/2014 Hellsten
8,711,029 B2 4/2014 Ferretti et al.
8,723,721 B2 5/2014 Moruzzis et al.
8,724,918 B2 5/2014 Abraham
8,760,634 B2 6/2014 Rose
8,768,104 B2 7/2014 Moses et al.
8,803,732 B2 8/2014 Antonik et al.
8,823,813 B2 9/2014 Mantzel et al.
8,824,544 B2 9/2014 Nguyen et al.
8,836,573 B2 9/2014 Yanagihara et al.
8,854,253 B2 10/2014 Edvardsson
8,854,255 B1 10/2014 Ehret
8,860,824 B2 10/2014 Jelinek
8,861,588 B2 10/2014 Nguyen et al.
8,879,793 B2 11/2014 Peterson
8,879,865 B2 11/2014 Li et al.
8,879,996 B2 11/2014 Kenney et al.
8,891,066 B2 11/2014 Bamler et al.
8,903,134 B2 12/2014 Abileah
8,912,950 B2 12/2014 Adcook
8,957,806 B2 2/2015 Schaefer
8,977,062 B2 3/2015 Gonzalez et al.
8,988,273 B2 3/2015 Marianer et al.
9,013,348 B2 4/2015 Riedel et al.
9,019,143 B2 4/2015 Obermeyer
9,019,144 B2 4/2015 Calabrese
9,037,414 B1 5/2015 Pratt
9,063,544 B2 6/2015 Vian et al.
9,071,337 B2 6/2015 Hellsten
9,106,857 B1 8/2015 Faramarzpour
9,126,700 B2 9/2015 Ozkul et al.
9,134,414 B2 9/2015 Bergeron et al.
9,148,601 B2 9/2015 Fox
9,176,227 B2 11/2015 Bergeron et al.
9,182,483 B2 11/2015 Liu et al.
9,210,403 B2 12/2015 Martinerie et al.
9,244,155 B2 1/2016 Bielas
9,261,592 B2 2/2016 Boufounos et al.
9,291,711 B2 3/2016 Healy, Jr. et al.
9,329,263 B2 5/2016 Haynes et al.
9,389,311 B1 7/2016 Moya et al.
9,395,437 B2 7/2016 Ton et al.
9,400,329 B2 7/2016 Pillay
9,411,039 B2 8/2016 Dehlink et al.
9,417,323 B2 8/2016 Carande et al.
9,426,397 B2 8/2016 Wein
9,529,081 B2 12/2016 Whelan et al.
9,531,081 B2 12/2016 Huber et al.
9,684,071 B2 6/2017 Wishart
9,684,673 B2 6/2017 Beckett et al.
10,230,925 B2 3/2019 Maciejewski et al.
2001/0013566 A1 8/2001 Yung et al.
2002/0003502 A1 1/2002 Falk
2002/0147544 A1 10/2002 Nicosia et al.
2002/0196178 A1 12/2002 Beard
2003/0006364 A1 1/2003 Katzir et al.
2004/0021600 A1 2/2004 Wittenberg
2004/0104859 A1 6/2004 Lo
2004/0150547 A1 8/2004 Suess et al.
2004/0227659 A1 11/2004 Woodford et al.
2005/0212692 A1 9/2005 Iny et al.
2005/0270299 A1 12/2005 Rasmussen et al.
2005/0288859 A1 12/2005 Golding et al.
2006/0132753 A1 6/2006 Nichols et al.
2007/0024879 A1 2/2007 Hamilton, Jr. et al.
2007/0051890 A1 3/2007 Pittman
2007/0080830 A1 4/2007 Sacks
2007/0102629 A1 5/2007 Richard et al.
2007/0120979 A1 5/2007 Zhang et al.
2007/0146195 A1 6/2007 Wallenberg et al.
2007/0168370 A1 7/2007 Hardy
2007/0192391 A1 8/2007 McEwan
2007/0279284 A1 12/2007 Karayil Thekkoott Narayanan
2008/0074338 A1* 3/2008 Vacanti ..... H01Q 1/28 343/771
2008/0081556 A1 4/2008 Robinson
2008/0123997 A1 5/2008 Adams et al.
2008/0240602 A1 10/2008 Adams et al.
2009/0011777 A1 1/2009 Grunebach et al.
2009/0021588 A1 1/2009 Border et al.
2009/0046182 A1 2/2009 Adams, Jr. et al.
2009/0046995 A1 2/2009 Kanumuri et al.
2009/0051585 A1 2/2009 Krikorian et al.
2009/0087087 A1 4/2009 Palum et al.
2009/0109086 A1 4/2009 Krieger et al.
2009/0147112 A1 6/2009 Baldwin
2009/0226114 A1 9/2009 Choi et al.
2009/0256909 A1 10/2009 Nixon
2009/0289838 A1 11/2009 Braun
2010/0039313 A1 2/2010 Morris
2010/0045513 A1 2/2010 Pett et al.
2010/0063733 A1 3/2010 Yunck
2010/0128137 A1 5/2010 Guidash
2010/0149396 A1 6/2010 Summa et al.
2010/0194901 A1 8/2010 van Hoorebeke et al.
2010/0232692 A1 9/2010 Kumar et al.
2010/0302418 A1 12/2010 Adams, Jr. et al.
2010/0309347 A1 12/2010 Adams, Jr. et al.
2010/0321235 A1 12/2010 Vossiek et al.
2010/0328499 A1 12/2010 Sun
2011/0052095 A1 3/2011 Deever
2011/0055290 A1 3/2011 Li et al.
2011/0098986 A1 4/2011 Fernandes Rodrigues et al.
2011/0115793 A1 5/2011 Grycewicz
2011/0115954 A1 5/2011 Compton
2011/0134224 A1 6/2011 McClatchie
2011/0156878 A1 6/2011 Wu et al.
2011/0175771 A1 7/2011 Raney
2011/0187902 A1 8/2011 Adams, Jr. et al.
2011/0199492 A1 8/2011 Kauker et al.
2011/0279702 A1 11/2011 Plowman et al.
2011/0282871 A1 11/2011 Seefeld et al.
2012/0019660 A1 1/2012 Golan et al.
2012/0044328 A1 2/2012 Gere
2012/0076229 A1 3/2012 Lee et al.
2012/0105276 A1 5/2012 Ryland
2012/0127028 A1 5/2012 Bamler et al.
2012/0127331 A1 5/2012 Grycewicz
2012/0133550 A1 5/2012 Benninghofen et al.
2012/0146869 A1 6/2012 Holland et al.
2012/0154584 A1 6/2012 Omer et al.
2012/0200703 A1 8/2012 Nadir et al.
2012/0201427 A1 8/2012 Jasinski et al.
2012/0257047 A1 10/2012 Biesemans et al.
2012/0271609 A1 10/2012 Laake et al.
2012/0274505 A1 11/2012 Pritt et al.
2012/0293669 A1 11/2012 Mann et al.
2012/0323992 A1 12/2012 Brobst et al.
2013/0021475 A1 1/2013 Canant et al.
2013/0050488 A1 2/2013 Brouard et al.
2013/0063489 A1 3/2013 Hourie et al.
2013/0080594 A1 3/2013 Nourse et al.
2013/0120205 A1 5/2013 Thomson et al.
2013/0201050 A1 8/2013 Hellsten
2013/0234879 A1 9/2013 Wilson-Langman et al.
2013/0257641 A1 10/2013 Ronning
2013/0321228 A1 12/2013 Crockett, Jr. et al.
2013/0321229 A1 12/2013 Klefenz et al.
2013/0335256 A1 12/2013 Smith et al.
2014/0027576 A1 1/2014 Boshuizen et al.
2014/0062764 A1 3/2014 Reis et al.
2014/0068439 A1 3/2014 Lacaze et al.

(56) References Cited

U.S. PATENT DOCUMENTS

| | | | |
|---|---|---|---|
| 2014/0078153 | A1 | 3/2014 | Richardson |
| 2014/0149372 | A1 | 5/2014 | Sankar et al. |
| 2014/0191894 | A1 | 7/2014 | Chen et al. |
| 2014/0232591 | A1 | 8/2014 | Liu et al. |
| 2014/0266868 | A1 | 9/2014 | Schuman |
| 2014/0282035 | A1 | 9/2014 | Murthy et al. |
| 2014/0307950 | A1 | 10/2014 | Jancsary et al. |
| 2014/0313071 | A1 | 10/2014 | McCorkle |
| 2014/0344296 | A1 | 11/2014 | Chawathe et al. |
| 2015/0015692 | A1 | 1/2015 | Smart |
| 2015/0080725 | A1 | 3/2015 | Wegner |
| 2015/0145716 | A1 | 5/2015 | Woodsum |
| 2015/0160337 | A1 | 6/2015 | Muff |
| 2015/0168554 | A1 | 6/2015 | Aharoni et al. |
| 2015/0247923 | A1 | 9/2015 | LaBarca et al. |
| 2015/0253423 | A1 | 9/2015 | Liu et al. |
| 2015/0280326 | A1 | 10/2015 | Arii |
| 2015/0323659 | A1 | 11/2015 | Mitchell |
| 2015/0323665 | A1 | 11/2015 | Murata |
| 2015/0323666 | A1 | 11/2015 | Murata |
| 2015/0324989 | A1 | 11/2015 | Smith et al. |
| 2015/0331097 | A1 | 11/2015 | Hellsten |
| 2015/0346336 | A1 | 12/2015 | Di Giorgio et al. |
| 2015/0369913 | A1 | 12/2015 | Jung et al. |
| 2015/0371431 | A1 | 12/2015 | Korb et al. |
| 2015/0378004 | A1 | 12/2015 | Wilson-Langman et al. |
| 2015/0378018 | A1 | 12/2015 | Calabrese |
| 2015/0379957 | A1 | 12/2015 | Roegelein et al. |
| 2016/0012367 | A1 | 1/2016 | Korb et al. |
| 2016/0019458 | A1 | 1/2016 | Kaufhold |
| 2016/0020848 | A1 | 1/2016 | Leonard |
| 2016/0033639 | A1 | 2/2016 | Jung et al. |
| 2016/0109570 | A1 | 4/2016 | Calabrese |
| 2016/0139259 | A1 | 5/2016 | Rappaport et al. |
| 2016/0139261 | A1 | 5/2016 | Becker |
| 2016/0170018 | A1 | 6/2016 | Yamaoka |
| 2016/0202347 | A1 | 7/2016 | Malinovskiy et al. |
| 2016/0204514 | A1* | 7/2016 | Miraftab ..... H01Q 21/005 343/737 |
| 2016/0216372 | A1 | 7/2016 | Liu et al. |
| 2016/0223642 | A1 | 8/2016 | Moore et al. |
| 2016/0238696 | A1 | 8/2016 | Hintz |
| 2016/0282463 | A1 | 9/2016 | Guy et al. |
| 2016/0300375 | A1 | 10/2016 | Beckett et al. |
| 2016/0306824 | A1 | 10/2016 | Lopez et al. |
| 2017/0160381 | A1 | 6/2017 | Cho et al. |
| 2017/0214889 | A1 | 7/2017 | Maciejewski et al. |
| 2018/0172823 | A1 | 6/2018 | Tyc |
| 2018/0172824 | A1 | 6/2018 | Beckett et al. |
| 2018/0252807 | A1 | 9/2018 | Fox |
| 2018/0322784 | A1 | 11/2018 | Schild |
| 2018/0335518 | A1 | 11/2018 | Fox |

FOREIGN PATENT DOCUMENTS

| | | | |
|---|---|---|---|
| CA | 2553008 | C | 1/2007 |
| CA | 2827279 | A1 | 4/2014 |
| CN | 101907704 | A | 12/2010 |
| CN | 102394379 | A | 3/2012 |
| CN | 103679714 | A | 3/2014 |
| DE | 102007039095 | A1 | 2/2009 |
| DE | 202009003286 | U1 | 5/2009 |
| EP | 0 924 534 | A2 | 6/1999 |
| EP | 0 846 960 | B1 | 3/2004 |
| EP | 1 504 287 | | 2/2005 |
| EP | 1698856 | A2 | 9/2006 |
| EP | 1509784 | B1 | 2/2008 |
| EP | 1746437 | B1 | 9/2008 |
| EP | 1966630 | B1 | 9/2008 |
| EP | 2 230 533 | A1 | 9/2010 |
| EP | 2 242 252 | A2 | 10/2010 |
| EP | 2392943 | B1 | 7/2011 |
| EP | 2416174 | A1 | 8/2012 |
| EP | 2560144 | A1 | 2/2013 |
| EP | 2610636 | A1 | 7/2013 |
| EP | 2762916 | A2 | 8/2014 |
| EP | 2778635 | A1 | 9/2014 |
| EP | 2 828 685 | | 1/2015 |
| EP | 2 875 384 | | 5/2015 |
| EP | 2662704 | B1 | 1/2016 |
| EP | 2743727 | B1 | 1/2016 |
| EP | 2759847 | B1 | 1/2016 |
| EP | 2762917 | B1 | 1/2016 |
| EP | 2767849 | B1 | 1/2016 |
| EP | 2896971 | B1 | 3/2016 |
| EP | 3012658 | A1 | 4/2016 |
| EP | 3032648 | A1 | 6/2016 |
| EP | 3 060 939 | | 8/2016 |
| EP | 3056922 | A2 | 8/2016 |
| EP | 2 784 537 | B1 | 10/2016 |
| EP | 3 077 985 | | 10/2016 |
| EP | 3 077 986 | | 10/2016 |
| EP | 3 214 460 | A1 | 9/2017 |
| JP | 56108976 | A | 8/1981 |
| JP | 60-257380 | A | 12/1985 |
| JP | 2001-122199 | A | 5/2001 |
| KR | 10-2010-0035056 | A | 4/2010 |
| KR | 10-2012-0000842 | A | 1/2012 |
| KR | 10-1461129 | B1 | 11/2014 |
| KR | 101461129 | B1 | 11/2014 |
| KR | 10-2016-0002694 | A | 1/2016 |
| RU | 2349513 | C2 | 3/2009 |
| WO | 2000-055602 | A1 | 9/2000 |
| WO | 02/18874 | A1 | 3/2002 |
| WO | 2002-056053 | A3 | 1/2003 |
| WO | 2003-005059 | A1 | 1/2003 |
| WO | 03/040653 | A1 | 5/2003 |
| WO | 2003-005080 | A2 | 7/2003 |
| WO | 03/096064 | A1 | 11/2003 |
| WO | 2007-076824 | A2 | 7/2007 |
| WO | 2009-025825 | A1 | 2/2009 |
| WO | 2009-030339 | A1 | 3/2009 |
| WO | 2009-085305 | A1 | 7/2009 |
| WO | 2010-052530 | A1 | 5/2010 |
| WO | 2010/122327 | A1 | 10/2010 |
| WO | 2011/138744 | A2 | 11/2011 |
| WO | 2011/154804 | A1 | 12/2011 |
| WO | 2012-120137 | A1 | 9/2012 |
| WO | 2012-143756 | A1 | 10/2012 |
| WO | 2012-148919 | A2 | 11/2012 |
| WO | 2013/112955 | A1 | 8/2013 |
| WO | 2013-162657 | A1 | 10/2013 |
| WO | 2014/012828 | A1 | 1/2014 |
| WO | 2014/089318 | A1 | 6/2014 |
| WO | 2014-097263 | A1 | 6/2014 |
| WO | 2015-059043 | A1 | 4/2015 |
| WO | 2015/112263 | A2 | 7/2015 |
| WO | 2015/130365 | A2 | 9/2015 |
| WO | 2015/192056 | A1 | 12/2015 |
| WO | 2016/022637 | A1 | 2/2016 |
| WO | 2016-132106 | A1 | 8/2016 |
| WO | 2016/153914 | A1 | 9/2016 |
| WO | 2016/202662 | A1 | 12/2016 |
| WO | 2016/205406 | A1 | 12/2016 |
| WO | 2017/048339 | A1 | 3/2017 |
| WO | 2017/091747 | A1 | 6/2017 |
| WO | 2017/094157 | A1 | 6/2017 |

OTHER PUBLICATIONS

Preliminary Amendment filed in Application No. PCT/US2015/043739, dated Feb. 7, 2017, 12 pages.

International Search Report and Written Opinion issued in PCT Application No. PCT/US2015/043739, dated Nov. 11, 2015, 12 pages.

Preliminary Amendment filed in U.S. Appl. No. 15/561,437, dated Sep. 25, 2017, 11 pages.

International Search Report and Written Opinion issued in PCT Application No. PCT/US2016/022841, dated Jun. 3, 2016, 10 pages.

Preliminary Amendment filed in U.S. Appl. No. 15/737,065, dated Dec. 15, 2017, 8 pages.

(56) References Cited

OTHER PUBLICATIONS

European Communication issued in European Application No. 14883549.9, dated Nov. 24, 2017, 8 pages.
Preliminary Amendment filed in U.S. Appl. No. 15/737,016, dated Dec. 15, 2017, 8 pages.
International Search Report and Written Opinion issued in PCT Application No. PCT/US2016/037675, dated Feb. 16, 10 pages.
International Search Report and Written Opinion issued in PCT Application No. PCT/US2016/063630, dated Feb. 13, 2017, 8 pages.
Analog Devices, MT-085 Tutorial, "Fundamentals of Direct Digital Synthesis (DDS)", 2008, pp. 1-9.
Bordoni, Federica, et al.: "Calibration Error Model for Multichannel Spacebome SAR Systems Based on Digital Beamforming", Proceedings of the 10th European Radar Conference, Oct. 9-11, 2013, pp. 184-187.
D'Aria, D., et al.: "A Wide Swath, Full Polarimetric, L band spaceborne SAR", IEEE, 2008, 4 pages.
El Sanhoury, Ahmed, et al: "Performance Improvement of Pulsed OFDM UWB Systems Using ATF coding", ICCCE, May 11-13, 2010, IEEE, 4 pages.
Freeman: IEEE Transactions on Geoscience and Remote Sensing, vol. 38, No. 1, Jan. 1, 2000, pp. 320-324.
Freeman, Anthony, et al.: On the Detection of Faraday Rotation in Linearly Polarized L-Band SAR Backscatter Signatures, IEEE Transactions on Geoscience and Remote Sensing, vol. 42, No. 8, Aug. 2004, pp. 1607-1616.
Giuli, D., et al.: "Radar target scattering matrix measurement through orthogonal signals" IEE Proceedings—F, vol. 140, No. 4, Part F, Aug. 1993, pp. 233-242.
Hossain, MD Anowar, et al.: "Multi-Frequency Image Fusion Based on MIMO UWB OFDM Synthetic Aperture Radar", New Advances in Image Fusion, INTECH Open Science/Open Minds, 2013, 21 pages.
Kankaku, Y., et al.: "The Overview of the L-band SAR Onboard ALOS-2", Progress in Electromagnetics Research Symposium Proceedings, Moscow, Russia, Aug. 18-21, 2009, pp. 735-738.
Lombardo, P., et al.: "Monitoring and surveillance potentialities obtained by splitting the antenna of the COSMO-SkyMed SAR into multiple sub-apertures", The Institution of Engineering and Technology, IEE Proceedings, Apr. 2006, pp. 104-116.
Meyer, Franz J., et al: "Prediction, Detection, and Correction of Faraday Rotation in Full-Polarimetric L-Band SAR Data", IEEE Transactions on Geoscience and Remote Sensing, vol. 46, No. 10, Oct. 2008, pp. 3076-3086.
Raney, Keith R: "Hybrid-Polarity SAR Architecture", IEEE Transactions on Geoscience and Remote Sensing, vol. 45, No. 11, Nov. 2007, pp. 3397-3404.
Rouse, Shane, et al.: "Swathbuckler Wide Area SAR Processing Front End", IEEE 2006, pp. 673-678.
Rudolf, Hans: "Increase of Information by Polarimetric Radar Systems", Doctoral Dissertation, 2000, 5 pages.
Sakiotis, N.G., et al.: Proceedings of the I.R.E., 1953, pp. 87-93.
Souissi, B., et al.: "Investigation of the capabaility of the Compact Polarimetry mode to Reconstruct Full Polarimetry mode using RADARSAT2 data", Advanced Electromagnetics, Vo. 1, No. 1, May 2012, 10 pages.
Space Dynamics Laboratory, "RASAR", 2013, 2 pages.
Van Zyl, Jakob, et al.: "Synthetic Aperture Radar Polarimetry", JPL Space Science and Technology Series, 2010, 333 pages.
Werninghaus, Rolf, et al.: "The TerraSAR-X Mission", 2004, 4 pages.
Wolff: "Radar Basics—Exciter", Radartutorial.eu, http://www.radartutorial.eu/08.transmitters/Exciter.en.html, downloaded Mar. 6, 2018, 2 pages.
Wright, P.A., et al.: "Faraday Rotation Effects on L-Band Spaceborne SAR Data", IEEE Transactions on Geoscience and Remote Sensing, vol. 41, No. 12, December 2003, pp. 2735-2744.
Zhang, T., et al.: "OFDM Synthetic Aperture Radar Imaging With Sufficient Cyclic Prefix", IEEE Transactions on Geoscience and Remote Sensing, vol. 53, No. 1, Jan. 2015, pp. 394-404.
International Search Report and Written Opinion for PCT Patent Application No. PCT/US2016/037666, dated Mar. 27, 2017, 8 Pages.
International Search Report and Written Opinion issued in PCT Application No. PCT/US2016/037666, dated Mar. 27, 2017, 8 pages.
International Preliminary Report on Patentability issued in PCT Application No. PCT/US2016/037666, dated Dec. 28, 2017, 7 pages.
International Preliminary Report on Patentability issued in PCT Application No. PCT/US2016/037675, dated Dec. 28, 2017, 9 pages.
International Search Report and Written Opinion issued in PCT Application No. PCT/US2016/037681, dated Sep. 23, 2016, 10 pages.
International Preliminary Report on Patentability issued in PCT Application No. PCT/US2016/037681, dated Dec. 28, 2017, 7 pages.
Extended European Search Report issued in European Application No. 16844829.8, dated Apr. 25, 2018, 9 pages.
Supplementary Partial Search Report issued in European Application No. 16846990.6, dated May 18, 2018, 16 pages.
Extended European Search Report issued in European Application No. 16812363.6, dated May 14, 2018, 8 pages.
Larson & J R Wertz (EDS): "Orbit Maintenance," Space Mission Analysis and Design, Jan. 1, 1997, pp. 153-154, 177 (XP002214373), 15 pages.
"Envi Tutorials," Sep. 1, 2000, URL:http://heim.ifi.uio.no/"inf160/tutorial.pdf (XP055472060), 590 pages.
International Preliminary Report on Patentability issued in PCT Application No. PCT/US2016/022841, dated Oct. 5, 2017, 8 pages.
Extended European Search Report issued in European Application No. 16846990.6, dated Aug. 16, 2018, 16 pages.
Caltagirone et al., "The COSMO-SkyMed Dual Use Earth Observation Program: Development, Qualification, and Results of the Commissioning of the Overall Constellation", IEEE Journal of Selected Topics in Applied Earth Observations and Remote Sensing, IEEE, USA, vol. 7, No. 7, Jul. 1, 2014, (XP011557179), 9 pages.
"ISR Systems and Technology," Lincoln Laboratory, Massachusetts Institute of Technology, archived Jan. 19, 2017, URL=https://www.ll.mit.edu/mission/isr/israccomplishments.html, download date Oct. 8, 2018, 2 pages.
"Northrop's SABR radar completes auto target cueing capability demonstration," May 20, 2013, URL=https://www.airforce-technology.com/news/newsnorthrops-sabr-radar-completes-auto-target-cueing-capability-demonstration/, download date Oct. 8, 2018, 3 pages.
Amendment, filed Jan. 17, 2019, for U.S. Appl. No. 15/101,336, Lopez et al., "Systems and Methods for Earth Observation," 25 pages.
Amendment, filed Sep. 5, 2018, for U.S. Appl. No. 15/316,469, Maciejewski et al., "Systems and Methods for Processing and Providing Terrestrial and/or Space-Based Earth Observation Video," 9 pages.
Beckett et al., "Systems and Methods for Enhancing Synthetic Aperture Radar Imagery," U.S. Appl. No. 62/180,449, filed Jun. 16, 2015, 34 pages.
Beckett, "UrtheCast Second-Generation Earth Observation Sensors," 36$^{th}$ *International Symposium on Remote Sensing of Environment*, Berlin, Germany, May 11-15, 2015, pp. 1069-1073.
Bickel et al., "Effects of Magneto-Ionic Propagation on the Polarization Scattering Matrix," *Proceedings of the IEEE* 53(8):1089-1091, 1965.
Bidigare, "MIMO Capacity of Radar as a Communications Channel," *Adaptive Sensor and Array Processing Workshop*, Lexington, Massachusetts, USA, Mar. 11-13, 2003, 19 pages.
Boccia, "Bathymetric Digital Elevation Model Generation from L-band and X-band Synthetic Aperture Radar Images in the Gulf of Naples, Italy: Innovative Techniques and Experimental Results," doctoral thesis, University of Naples Federico II, Naples, Italy, 2015, 161 pages.

(56) References Cited

OTHER PUBLICATIONS

Bordoni et al., "Ambiguity Suppression by Azimuth Phase Coding in Multichannel SAR Systems," *International Geoscience and Remote Sensing Symposium*, Vancouver, Canada, Jul. 24-29, 2011, 16 pages.
Brysk, "Measurement of the Scattering Matrix with an Intervening Ionosphere," *Transactions of the American Institute of Electrical Engineers* 77(5):611-612, 1958.
Di Iorio et al., "Innovation Technologies and Applications for Coastal Archaeological sites FP7—ITACA," 36$^{th}$ *International Symposium on Remote Sensing of Environment*, Berlin, Germany, May 11-15, 2015, pp. 1367-1373.
Evans, "Venus, Unmasked: 25 Years Since the Arrival of Magellan at Earth's Evil Twin," Aug. 10, 2015, URL=http://www.americaspace.com/2015/08/10/venus-unmasked-25-years-since-the-arrival-of-magellan-at-earths-evil-twin/, download date Oct. 8, 2018, 4 pages.
Extended European Search Report, dated Mar. 27, 2018, for European Application No. 15829734.1-1206, 18 pages.
Extended European Search Report, dated Oct. 24, 2016, for European Application No. 14880012.1-1951, 10 pages.
Extended European Search Report, dated Oct. 24, 2016, for European Application No. 14883549.9-1951, 10 pages.
Fard et al., "Classifier Fusion of High-Resolution Optical and Synthetic Aperture Radar (SAR) Satellite Imagery for Classification in Urban Area," 1$^{st}$ *International Conference on Geospatial Information Research*, Tehran, Iran, Nov. 15-17, 2014, 5 pages.
Forkuor et al., "Integration of Optical and Synthetic Aperture Radar Imagery for Improving Crop Mapping in Northwestern Benin, West Africa," *Remote Sensing* 6(7):6472-6499, 2014.
Fox et al., "Apparatus and Methods for a Synthetic Aperture Radar With Multi-Aperture Antenna," U.S. Appl. No. 62/510,182, filed May 23, 2017, 42 pages.
Fox et al., "Apparatus and Methods for a Synthetic Aperture Radar With Self-Cueing," U.S. Appl. No. 62/510,132, filed May 23, 2017, 39 pages.
Fox et al., "Range Ambiguity Suppression in Digital Multibeam," U.S. Appl. No. 62/590,153, filed Nov. 22, 2017, 19 pages.
Fox et al., "Synthetic Aperture Radar Imaging Apparatus and Methods for Moving Targets," U.S. Appl. No. 62/510,191, filed May 23, 2017, 24 pages.
Fox, "Apparatus and Methods for Quad-Polarized Synthetic Aperture Radar," U.S. Appl. No. 62/035,279, filed Aug. 8, 2014, 52 pages.
Fox, "Apparatus and Methods for Synthetic Aperture Radar With Digital Beamforming," U.S. Appl. No. 62/137,934, filed Mar. 25, 2015, 45 pages.
Fox, "Synthetic Aperture Radar Imaging Apparatus and Methods," U.S. Appl. No. 62/260,063, filed Nov. 25, 2015, 41 pages.
Fox, "Synthetic Aperture Radar Imaging Apparatus and Methods," U.S. Appl. No. 62/510,123, filed May 23, 2017, 74 pages.
Hadjis, "Automatic Modulation Classification of Common Communication and Pulse Compression Radar Waveforms Using Cyclic Features," master's thesis, Air Force Institute of Technology, Wright-Patterson Air Force Base, Ohio, USA, Mar. 2013, 96 pages.
Heege et al., "Mapping of water depth, turbidity and sea state properties using multiple satellite sensors in aquatic systems," *Hydro 2010*, Rostock, Germany, Nov. 2-5, 2010, 27 pages.
Hoogeboom et al., "Integrated Observation Networks of the Future," 4$^{th}$ *Forum on Global Monitoring for Environment and Security*, Baveno, Italy, Nov. 26-28, 2003, 14 pages.
Hounam et al., "A Technique for the Identification and Localization of SAR Targets Using Encoding Transponders," *IEEE Transactions on Geoscience and Remote Sensing* 39(1):3-7, 2001.
Huang et al., "Analog Beamforming and Digital Beamforming on Receive for Range Ambiguity Suppression in Spaceborne SAR," *International Journal of Antennas and Propagation* 2015:182080, 2015. (7 pages).
Huang et al., "ASTC-MIMO-TOPS Mode with Digital Beam-Forming in Elevation for High-Resolution Wide-Swath Imaging," *Remote Sensing* 7(3):2952-2970, 2015.
International Preliminary Report on Patentability, dated Dec. 15, 2016, for International Application No. PCT/US2015/035628, 8 pages.
International Preliminary Report on Patentability, dated Feb. 14, 2017, for International Application No. PCT/US2015/043739, 10 pages.
International Preliminary Report on Patentability, dated Jun. 7, 2016, for International Application No. PCT/US2014/068642, 10 pages.
International Preliminary Report on Patentability, dated Jun. 7, 2016, for International Application No. PCT/US2014/068645, 14 pages.
International Preliminary Report on Patentability, dated May 29, 2018, for International Application No. PCT/US2016/063630, 6 pages.
International Search Report and Written Opinion, dated Aug. 27, 2015, for International Application No. PCT/US2014/068642, 13 pages.
International Search Report and Written Opinion, dated Sep. 13, 2018, for International Application No. PCT/US2018/033970, 15 pages.
International Search Report and Written Opinion, dated Sep. 13, 2018, for International Application No. PCT/US2018/033971, 13 pages.
International Search Report and Written Opinion, dated Sep. 13, 2018, for International Application No. PCT/US2018/034144, 11 pages.
International Search Report and Written Opinion, dated Sep. 13, 2018, for International Application No. PCT/US2018/034146, 8 pages.
International Search Report and Written Opinion, dated Sep. 2, 2015, for International Application No. PCT/US2014/068645, 16 pages.
International Search Report and Written Opinion, dated Sep. 21, 2015, for International Application No. PCT/US2015/035628, 10 pages.
Kimura, "Calibration of Polarimetric PALSAR Imagery Affected by Faraday Rotation Using Polarization Orientation," *IEEE Transactions on Geoscience and Remote Sensing* 47(12):3943-3950, 2009.
Krieger et al., "CEBRAS: Cross Elevation Beam Range Ambiguity Suppression for High-Resolution Wide-Swath and MIMO-SAR Imaging," *International Geoscience and Remote Sensing Symposium*, Milan, Italy, Jul. 26-31, 2015, pp. 196-199.
Krieger et al., "Multidimensional Waveform Encoding: A New Digital Beamforming Technique for Synthetic Aperture Radar Remote Sensing," *IEEE Transactions on Geoscience and Remote Sensing* 46(1):31-46, 2008.
Linne von Berg, "Autonomous Networked Multi-Sensor Imaging Systems," *Imaging Systems and Applications*, Monterey, California, USA, Jun. 24-28, 2012, 2 pages.
Linne von Berg, "Multi-Sensor Airborne Imagery Collection and Processing Onboard Small Unmanned Systems," *Proceedings of SPIE* 7668(1):766807, 2010. (11 pages).
Livingstone et al., "RADARSAT-2 System and Mode Description," *Systems Concepts and Integration Symposium*, Colorado Springs, Colorado, USA, Oct. 10-12, 2005, 22 pages.
Lopez et al., "Systems and Methods for Earth Observation," U.S. Appl. No. 61/911,914, filed Dec. 4, 2013, 177 pages.
Ma, "Application of RADARSAT-2 Polarimetric Data for Land Use and Land Cover Classification and Crop Monitoring in Southwestern Ontario," master's thesis, The University of Western Ontario, Canada, 2013, 145 pages.
Maciejewski et al., "Systems and Methods for Processing and Providing Video," U.S. Appl. No. 62/011,935, filed Jun. 13, 2014, 52 pages.
Makar et al., "Real-Time Video Streaming With Interactive Region-of-Interest," *Proceedings of 2010 IEEE 17$^{th}$International Conference on Image Processing*, Hong Kong, China, Sep. 26-29, 2010, pp. 4437-4440.
Meilland et al., "A Unified Rolling Shutter and Motion Blur Model for 3D Visual Registration," *IEEE International Conference on Computer Vision*, Sydney, Australia, Dec. 1-8, 2013, pp. 2016-2023.

(56) References Cited

OTHER PUBLICATIONS

National Instruments, "Direct Digital Synthesis," white paper, Dec. 30, 2016, 5 pages.
Notice of Allowance, dated Mar. 9, 2017, for U.S. Appl. No. 15/101,344, Beckett et al., "Systems and Methods for Processing and Distributing Earth Observation Images," 9 pages.
Notice of Allowance, dated Oct. 18, 2018, for U.S. Appl. No. 15/316,469, Maciejewski et al., "Systems and Methods for Processing and Providing Terrestrial and/or Space-Based Earth Observation Video," 8 pages.
Office Action, dated Apr. 23, 2018, for U.S. Application No. 15/316,469, Maciejewski et al., "Systems and Methods for Processing and Providing Terrestrial and/or Space-Based Earth Observation Video," 21 pages.
Office Action, dated Aug. 6, 2018, for U.S. Appl. No. 15/101,336, Lopez et al., "Systems and Methods for Earth Observation," 25 pages.
Office Action, dated Feb. 11, 2019, for U.S. Appl. No. 15/502,468, Fox, "Apparatus and Methods for Quad-Polarized Synthetic Aperture Radar," 42 pages.
Pleskachevsky et al., "Synergy and fusion of optical and synthetic aperture radar satellite data for underwater topography estimation in coastal areas," *Ocean Dynamics* 61(12):2099-2120, 2011.
Preliminary Amendment, filed Dec. 15, 2017, for U.S. Appl. No. 15/737,044, Beckett et al., "Systems and Methods for Enhancing Synthetic Aperture Radar Imagery," 10 pages.
Preliminary Amendment, filed Dec. 5, 2016, for U.S. Appl. No. 15/316,469, Maciejewski et al., "Systems and Methods for Processing and Providing Terrestrial and/or Space-Based Earth Observation Video," 9 pages.
Preliminary Amendment, filed Jun. 2, 2016, for U.S. Appl. No. 15/101,336, Lopez et al., "Systems and Methods for Earth Observation," 9 pages.
Preliminary Amendment, filed Jun. 2, 2016, for U.S. Appl. No. 15/101,344, Beckett et al., "Systems and Methods for Processing and Distributing Earth Observation Images," 11 pages.
Preliminary Amendment, filed May 22, 2018, for U.S. Application No. 15/778,188, Fox, "Synthetic Aperture Radar Imaging Apparatus and Methods," 9 pages.
Raouf et al., "Integrated Use of SAR and Optical Data for Coastal Zone Management," *Proceedings of the 3rd European Remote Sensing Symposium* vol. 2, Florence, Italy, Mar. 14-21, 1997, pp. 1089-1094.
Richardson, "By the Doppler's sharp stare," Oct. 1, 2003, *Armada International*, URL=https://www.thefreelibrary.com/_/print/PrintArticle.aspx?id=111508265, download date Oct. 8, 2018, 7 pages.
Rosen et al., "Techniques and Tools for Estimating Ionospheric Effects in Interferometric and Polarimetric SAR Data," *International Geoscience and Remote Sensing Symposium, Vancouver*, British Columbia, Canada, Jul. 24-29, 2011, pp. 1501-1504.
Rossler, "Adaptive Radar with Application to Joint Communication and Synthetic Aperture Radar (CoSAR)," doctoral dissertation, The Ohio State University, Columbus, Ohio, USA, 2013, 117 pages.
Sano et al., "Synthetic Aperture Radar (L band) and Optical Vegetation Indices for Discriminating the Brazilian Savanna Physiognomies: A Comparative Analysis," *Earth Interactions* 9( 15):15, 2005. (15 pages).
Šindelář et al., "A Smartphone Application for Removing Handshake Blur and Compensating Rolling Shutter," *IEEE International Conference on Image Processing*, Paris, France, Oct. 27-30, 2014, pp. 2160-2162.
Šindelář et al., "Image deblurring in smartphone devices using built-in inertial measurement sensors," *Journal of Electronic Imaging* 22(1):011003, 2013. (22 pages).
Stofan et al., "Overview of Results of Spaceborne Imaging Radar-C, X-B and Synthetic Aperture Radar (SIR-C/X-SAR)," *IEEE Transactions on Geoscience and Remote Sensing* 33(4):817-828, 1995.
Stralka, "Applications of Orthogonal Frequency-Division Multiplexing (OFDM) to Radar," doctoral dissertaion, Johns Hopkins University, Baltimore, Maryland, USA, Mar. 2008, 196 pages.
Tyc, "Systems and Methods for Remote Sensing of the Earth From Space," U.S. Appl. No. 62/180,440, filed Jun. 16, 2015, 29 pages.
Wall et al., "User Guide to the Magellan Synthetic Aperture Radar Images," Jet Propulsion Laboratory, Pasadena, California, USA, Mar. 1995, 210 pages.
Wu et al., "Simultaneous transmit and receive polarimetric synthetic aperture radar based on digital beamforming," *4th International Conference on Mechatronics, Materials, Chemistry and Computer Engineering*, Xi'an, China, Dec. 12-13, 2015, pp. 1283-1288.
Xia et al., "Classification of High Resolution Optical and SAR Fusion Image Using Fuzzy Knowledge and Object-Oriented Paradigm," *Geographic Object-Based Image Analysis* vol. XXXVIII-4/C7, Ghent, Belgium, Jun. 29-Jul. 2, 2010, 5 pages.
Office Action, dated Oct. 4, 2019, for U.S. Appl. No. 15/737,044, Keith Dennis Richard Beckett et al., "System and Methods for Enhancing Synthetic Aperture Radar Imagery," 14 pages.
Office Action, dated Oct. 18, 2019, for U.S. Appl. No. 15/737,016, George Tyc, "Systems and Methods for Remote Sensing of the Earth From Space," 18 pages.
Foody, Gile M., "Status of Land Cover Classification Accuracy Assessment", University of Southampton, Jul. 21, 2001 (Year: 2001), 17 pages.

* cited by examiner

EFFICIENT PLANAR PHASED ARRAY ANTENNA ASSEMBLY

CROSS-REFERENCE TO RELATED APPLICATIONS

This present application is a National Phase Application Filed Under 35 U.S.C. 371 claiming priority to PCT/US2016/037666 filed Jun. 15, 2016, which in turn claims priority from U.S. Provisional Application Ser. No. 62/180,421 filed Jun. 16, 2015, the entire disclosures of which are incorporated herein by reference.

BACKGROUND

Technical Field

The present application relates generally to phased array antennas and, more particularly, to efficient phased array antennas suitable for dual band synthetic aperture radar.

INTRODUCTION

A multi-frequency, multi-polarimetric synthetic aperture radar (SAR) is desirable but the limitations of payload, data rate, budget, spatial resolution, area of coverage, and so on, present significant technical challenges to implementing a multi-frequency, fully polarimetnc SAR especially on spaceborne platforms.

The Shuttle Imaging Radar SIR-C is an example of a SAR that operated at more than one frequency band. The two antennas did not share a common aperture, however, and the mass was too large for deployment on the International Space Station (ISS) or on a SmallSAT platform.

An antenna configuration, especially on a spaceborne platform, can be constrained for various reasons in area and thickness. For example, the physical limitations of the launch vehicle can impose constraints on the sizing of the antenna. A constraint on the area of the antenna can, in turn, place a constraint on directivity. For this reason, efficiency can be a major driver of antenna design, and finding ways to reduce antenna losses can become important.

Existing approaches to the design of multi-frequency phased array antennas can include the use of microstrip arrays. These can be associated with high losses and consequently low efficiency.

The technology described in this application relates to the design and build of a cost-effective, high-efficiency, structurally-sound SAR antenna suitable for ISS and SmallSAT deployment, constrained by thickness and with dual frequency operation and full polarization on at least one frequency band.

In addition to the need for low profile, high-efficiency radar antennas, there is a similar need for commercial microwave and mm-wave antennas such as in radio point-to-point and point-to-multipoint link applications. Typically, a reflector antenna is used for these applications. However, the reflector and feed horn together present a considerable thickness.

One lower-profile alternative is the microstrip planar array. Several layers are often required and special arrangements are sometimes necessary to prevent parallel plate modes from propagating between different layers. These characteristics together with the cost of low-loss materials and the supporting structure make the approach less attractive. It is also difficult to reduce the losses for a microstrip array, especially at high frequencies. So, while the use of a microstrip array can reduce the thickness of the antenna, the antenna is lossy and the area of the antenna needs to be larger than a reflector antenna to achieve the same gain.

BRIEF SUMMARY

A planar phased array antenna assembly may be summarized as including a first face sheet, the first face sheet comprising a first plurality of radiating slots for a first frequency band and a second plurality of radiating slots for a second frequency band; a second face sheet; a structure interposed between the first face sheet and the second face sheet, the structure comprising a third plurality of radiating elements at the first frequency band and a fourth plurality of radiating elements at the second frequency band, the structure further comprising a first feed network for the third plurality of radiating elements and a second feed network for the fourth plurality of radiating elements: and a third face sheet wherein the second face sheet is interposed between the structure and the third face sheet.

The assembly may be structurally self-supporting. Substantially the entire assembly may consist of radiating elements and feed networks. The first face sheet, the second face sheet, the third face sheet, and the structure may each include machined aluminium. Each of the third plurality of radiating elements may include a folded cavity coupled to at least one of the first plurality of radiating slots. Each of the fourth plurality of radiating elements may include at least one waveguide coupled to at least one of the second plurality of radiating slots, and the third face sheet may include waveguide terminations. Each of the at least one waveguide may be a ridged waveguide. The first frequency hand may be L-band and the second frequency hand may be X-band. The first feed network may include at least one stripline, and at least one probe coupled to each of the third plurality of radiating elements. The second feed network may include at least one coaxial cable coupled to each of the fourth plurality of radiating elements. The first plurality of radiating slots may include a plurality of crossed slots, the crossed slots operable to radiate horizontally polarized and vertically polarized microwaves. The plurality of crossed slots may be flared in at least one of an in-plane and a through-plane orientation. The folded cavity may be at least partially filled with dielectric material. The first, the second and the third face sheets and the structure interposed between the first and the second face sheets may include a sole support structure of the planar phased array antenna assembly that self supports the planar phased array antenna assembly without any additional structure.

A synthetic aperture radar (SAR) antenna may include the planar phased array antenna assembly.

BRIEF DESCRIPTION OF THE SEVERAL VIEWS OF THE DRAWINGS

In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn, are not necessarily intended to convey any information regarding the actual shape of the particular elements, and may have been solely selected for ease of recognition in the drawings.

DETAILED DESCRIPTION

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its broadest sense, that is as meaning "and/or" unless the content clearly dictates otherwise.

The Abstract of the Disclosure provided herein is for convenience only and does not interpret the scope or meaning of the embodiments.

In a conventional antenna assembly, the radiating elements are typically mounted on a structural subassembly such as an aluminium honeycomb sheet. The structural subassembly contributes to the overall mass and volume of the antenna assembly without enhancing the electromagnetic performance.

The radiating elements are typically not self-supporting and are mounted to the structural subassembly. The radiating elements often comprise dielectric materials which, in combination with dielectric materials used to attach the radiating elements to the structural subassembly, can result in significant antenna losses.

Using conventional technology, a multi-frequency antenna can be implemented using patch elements. Such patch elements are sometimes layered or stacked, and are perforated to allow a smaller radiating element to radiate through a larger radiating element, for example an X-band radiating element radiating through an L-band radiating element.

In the present approach, the microwave structure comprises radiating elements in one or more subarrays, and does not require a separate structural subassembly. The microwave subarrays can be self-supporting and configured so that the radiating elements of the microwave subarrays serve also as structural elements.

Furthermore, a multi-frequency antenna assembly can be arranged to integrate radiating elements for two hands (such as X-band and L-band) into a common aperture. For example, X-band slot or patch radiating elements can be placed in the spaces between L-band slots.

Figure 1:
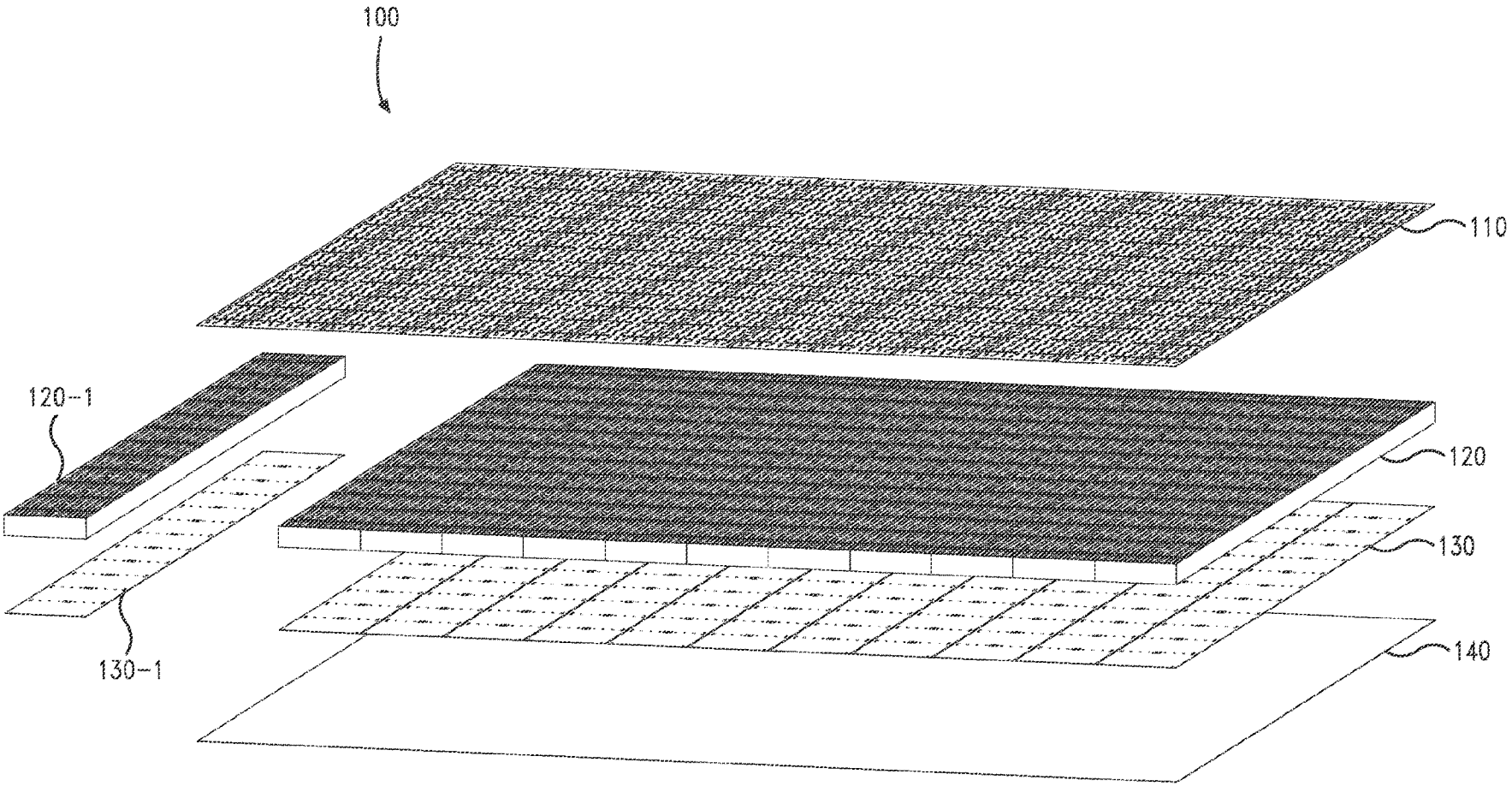
FIG. 1 is an exploded isometric view of an efficient planar phased array antenna assembly, according to at least a first illustrated embodiment.

FIG. 1 shows an efficient planar phased array antenna assembly 100, according to at least a first illustrated embodiment. The size of antenna assembly 100 can be tailored to meet the gain and bandwidth requirements of a particular application. An example application is a dual-band, dual-polarization SAR antenna. In an example implementation of a dual-band, dual-polarization SAR antenna, assembly 100 is approximately 2.15 m wide, 1.55 m long and 50 mm deep, and weighs approximately kg.

Antenna assembly 100 is an example of a dual-band (X-band and L-band), dual-polarization (H and V polarizations at L-band) SAR antenna assembly. While embodiments described in this document relate to dual X-band and L-band SAR antennas, and the technology is particularly suitable for space-based SAR antennas for reasons described elsewhere in this document, a similar approach can also be adopted for other frequencies, polarizations, configurations, and applications including, but not limited to, single-band and multi-band SAR antennas at different frequencies, and microwave and mm-wave communication antennas.

Antenna assembly 100 comprises a first face sheet 110 on a top surface of antenna assembly 100, containing slots for the L-band and X-band radiating elements (shown in detail in subsequent figures).

Antenna assembly 100 comprises microwave structure 120 below first face sheet 110. Microwave structure 120 comprises one or more subarrays such as subarray 120-1, each subarray comprising L-band and X-band radiating elements. The radiating elements are described in more detail below.

Microwave structure 120 is a metal structure that is self-supporting and does not require a separate structural subassembly. Microwave structure 120 can be machined or fabricated from one or more metal blocks, such as aluminium blocks or blocks of another suitable conductive material. The choice of material for microwave structure 120 determines, at least in part, the losses and therefore the efficiency of the antenna.

Antenna assembly 110 comprises second face sheet 130 below microwave structure 120, second face sheet 130 closing one or more L-band cavities at the hack. The L-band cavities are described in more detail below in reference to FIG. 11.

Antenna assembly 110 comprises third face sheet 140 below second face sheet 130, third face sheet 140 comprising waveguide terminations. Third face sheet 140 also provides at least partial structural support for antenna assembly 110.

In some implementations, antenna assembly 110 comprises a multi-layer printed circuit board (PCB) (not shown in FIG. 1) below third face sheet 140, the PCB housing a corporate feed network for the X-band and L-band radiating elements.

Figure 2:
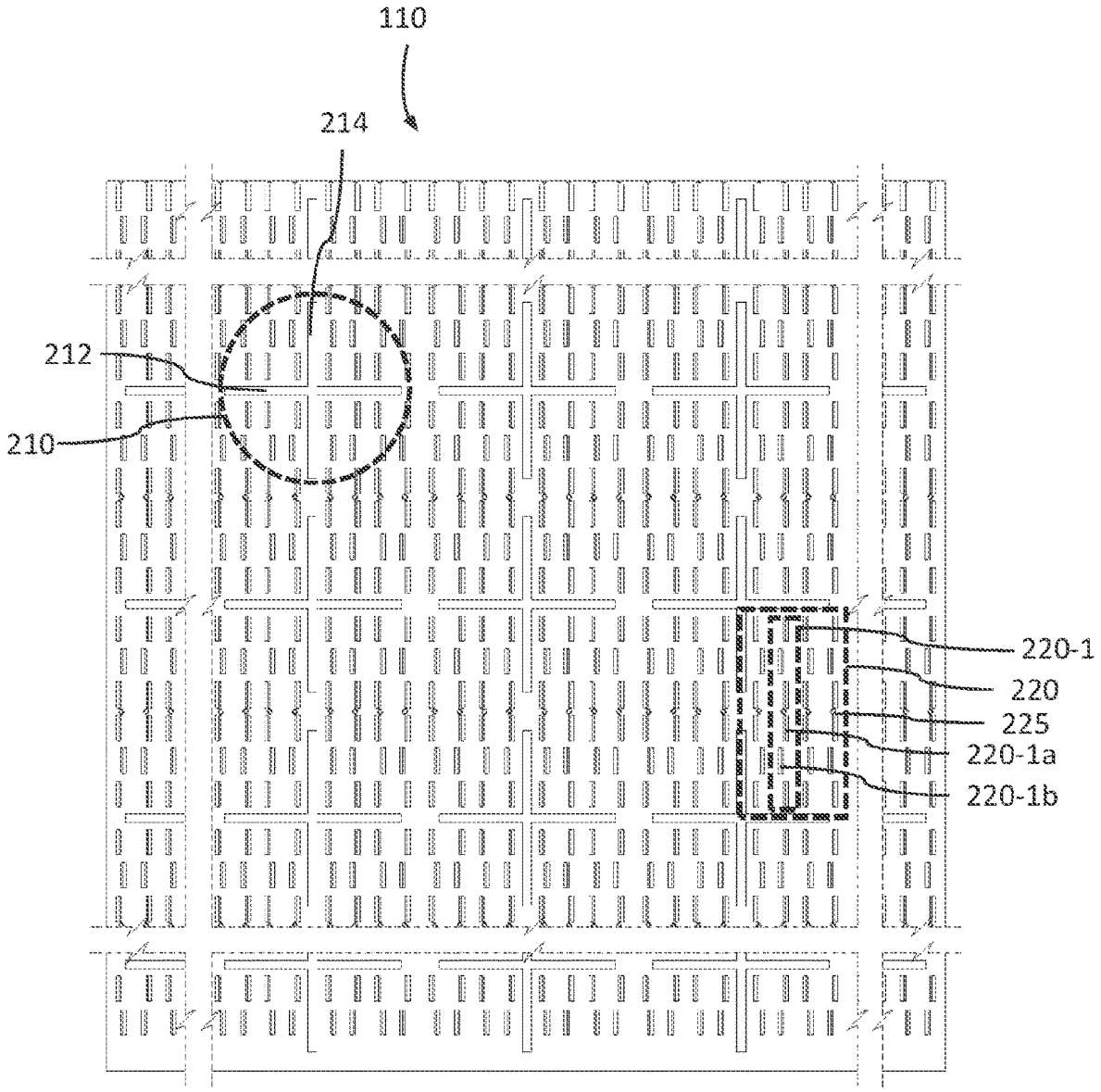
FIG. 2 is a front plan view of a portion of the first face sheet of the efficient planar phase array antenna assembly of FIG. 1.

FIG. 2 is a plan view of a portion of first face sheet 110 of efficient planar phase array antenna assembly 100 of FIG. 1. First face sheet 110 comprises a plurality of L-band radiating elements, such as L-band radiating element 210. L-band radiating element 210 comprises an L-band H-polarization slot 212, and an L-band V-polarization slot 214.

First face sheet 110 further comprises a plurality of X-band radiating elements such as X-band radiating element 220. X-band radiating element 220 comprises one or more X-band waveguides. In the example shown in FIG. 2. X-band element comprises four X-band waveguides, such as X-band waveguide 220-1. X-band waveguide 220-1 comprises a plurality of X-band slots. In the example shown, X-band waveguide 220-1 comprises six slots, for example X-band slots 220-1*a* and 220-1*b*. X-band waveguide 220-1 further comprises X-band feed 225.

The length of X-band slots, such as X-band slots 220-1*a* and 220-1*b*, determines, at least in part, the resonant frequency of antenna assembly 100. The offset of each X-band slot (such as X-band slots 220-1*a* and 220-1*b*) from the center line of the X-band waveguide (such as X-band waveguide 220-1), at least in part, defines the radiation efficiency.

Since the X-bands slots belonging to adjacent X-band waveguides are offset in opposite directions from the center line of the respective waveguide, the feeds are configured to be 180° out of phase with each other, so that radiation emitted from adjacent waveguides is in phase.

The spacing between each X-band element and between each L-band element can be selected to eliminate, or at least reduce, the effect of grating lobes and scan blindness (loss of gain at one or more scan angles).

Figure 3:
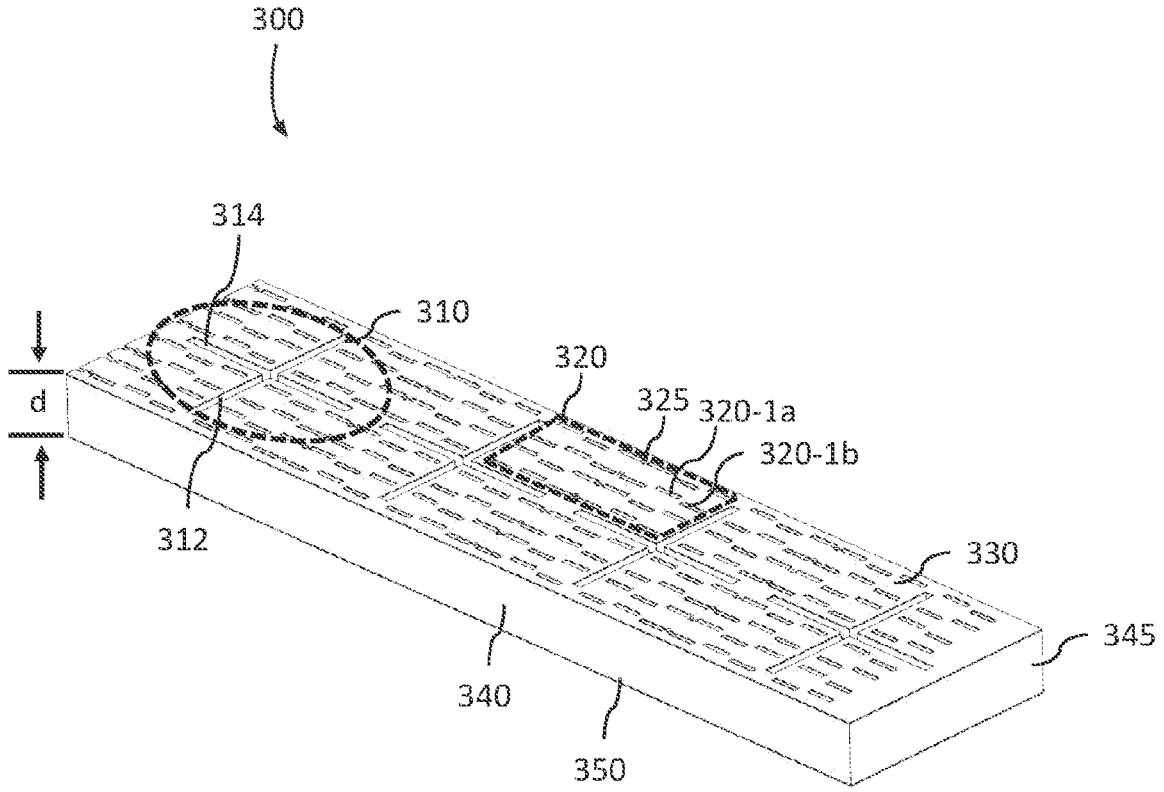
FIG. 3 is an isometric view of a microwave subarray of the efficient planar phase array antenna assembly of FIG. 1.

FIG. 3 is an isometric view of a microwave subarray 300 of the efficient planar phase array antenna assembly of FIG. 1. Microwave subarray 300 comprises radiating elements 310 and 320 for L-band and X-band, respectively. Microwave subarray 300 further comprises L-band and X-band feeds and feed housings (not shown in FIG. 3).

Figure 6:
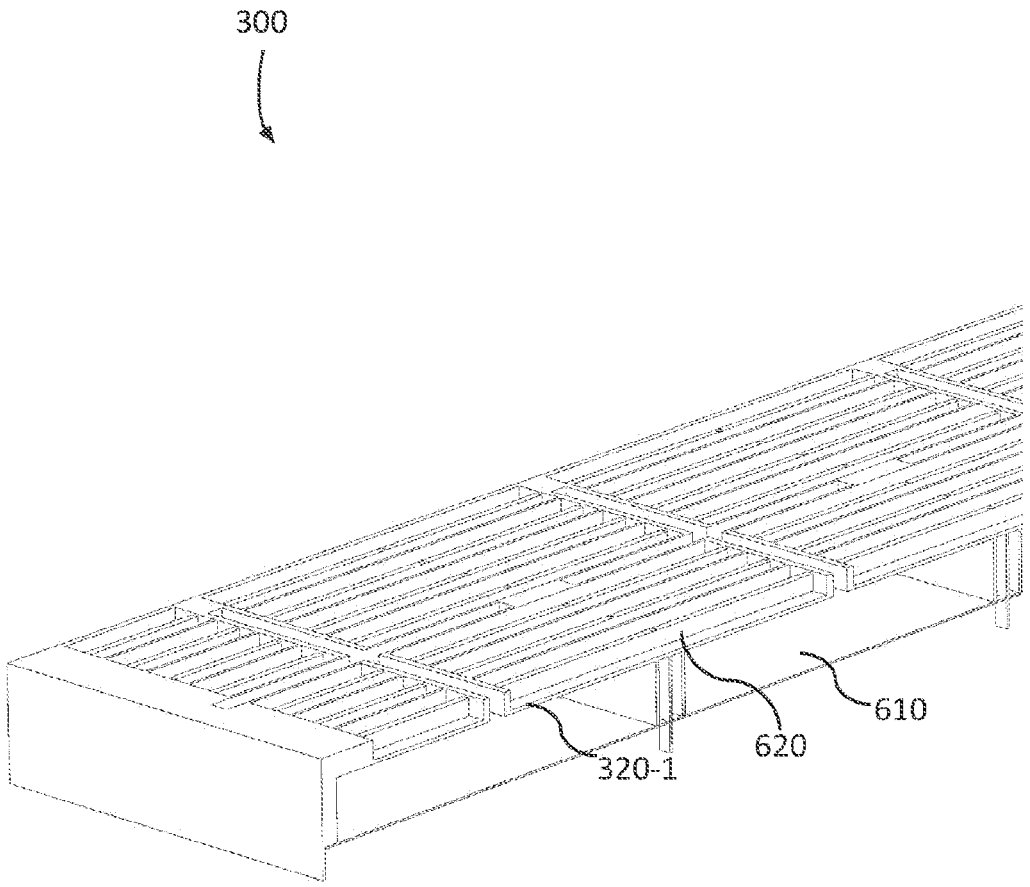
FIG. 6 is an isometric partial view of a close-up of the microwave subarray of FIG. 3 with a side removed to show the L-band cavity.

L-band radiating element has a crossed slot for horizontal and vertical polarizations, and a backing cavity. The use of a resonant cavity behind the aperture as shown in FIG. 6 reduces the depth required for the slot antenna. The volumes around the crossed L-band slot can be used for X-band radiating elements as described below.

L-band radiating element 310 comprises an L-band H-polarization slot 312 and an L-band V-polarization slot 314. X-band radiating element 320 comprises four waveguides, each waveguide comprising a plurality of slots such as 320-1*a* and 320-1*b*.

In an example implementation, the space between the first face sheet and the cavity is about 15 mm thick. This is thick enough to fit an X-band waveguide radiating from its broad dimension. Waveguide implementation of the X-band elements is an attractive option because it is low-loss and increases the efficiency of the antenna.

The space between L-band slots can accommodate more than one X-band waveguide radiator. One implementation uses a ridged waveguide to increase bandwidth at the expense of higher attenuation and lower power-handling capability. The ridged waveguide can be fed at the centre. The X-band radiators can be fed by probe excitation or by loop-coupled excitation of the waveguide.

As shown in FIG. 3, the L-band crossed slots form boundaries around the X-band radiating elements. In one embodiment, two sets of four X-band ridged waveguides can fit between each pair of L-band crossed slots. In another embodiment, with different gain requirements, a single set of four X-band ridged waveguides is positioned between each pair of L-band crossed slots.

Microwave subarray 300 further comprises top face sheet 330, side sheet 340, end sheet 345, and bottom face sheet 350. Bottom face sheet 350 is a ground plane and reflector for the L-band radiating elements. Thickness d of microwave subarray 300 is frequency dependent. Thickness d corresponds to the depth of the L-band cavity (shown in FIG. 6) and would typically be $\lambda/4$ for a slot antenna, where A is the L-band wavelength. As described in more detail below, thickness d of microwave subarray 300 can be smaller than $\lambda/4$ by using a folded L-band cavity.

The ideal slot antenna is $\lambda/4$ deep, and comprises a slot, rather than a slot with an opening into an associated cavity. At L-band wavelengths, the depth of the slot (which drives the thickness of the antenna assembly) would be approximately 6 cm. It is desirable to reduce the thickness of the antenna assembly, to leave room for feeds and electronics, and to meet requirements on antenna dimensions such as those imposed by launch vehicle dimensions.

Simply reducing the depth of the L-band slot would result in an antenna that is difficult to match. The antenna would have low impedance, owing to the presence of the electrically conductive wall near the feed and near the radiating slot.

The technology described in this application comprises a resonant cavity behind the aperture. Conceptually, each L-band slot is first bifurcated and then each bifurcation gradually turned to the side so that it forms a "T". The cross-piece of the "T" lies under the area of the antenna subassembly top face sheet occupied by the L-Band radiating element. In implementation, each L-band slot opens into an L-band cavity (as shown in FIG. 6).

In order for the slot to radiate efficiently, it requires a surrounding conductive surface to support the currents. A number of X-band radiating elements can be placed in the area of the microwave subarray surrounding the L-band slots.

In one embodiment, the L-band feed can be implemented in low-loss substrate material placed at the side of the microwave subarray, with probes across the L-band slots. Since, in this embodiment, the L-band feed housings are along the side of microwave subarray 300, they can act as stiffeners for the microwave subarray.

In another embodiment, the L-band feed can be implemented using stripline between the slots and the cavities. This is described in more detail below.

The number of microwave subarrays is selected to achieve the desired gain, coverage and target resolution for its intended purpose.

Figure 4:
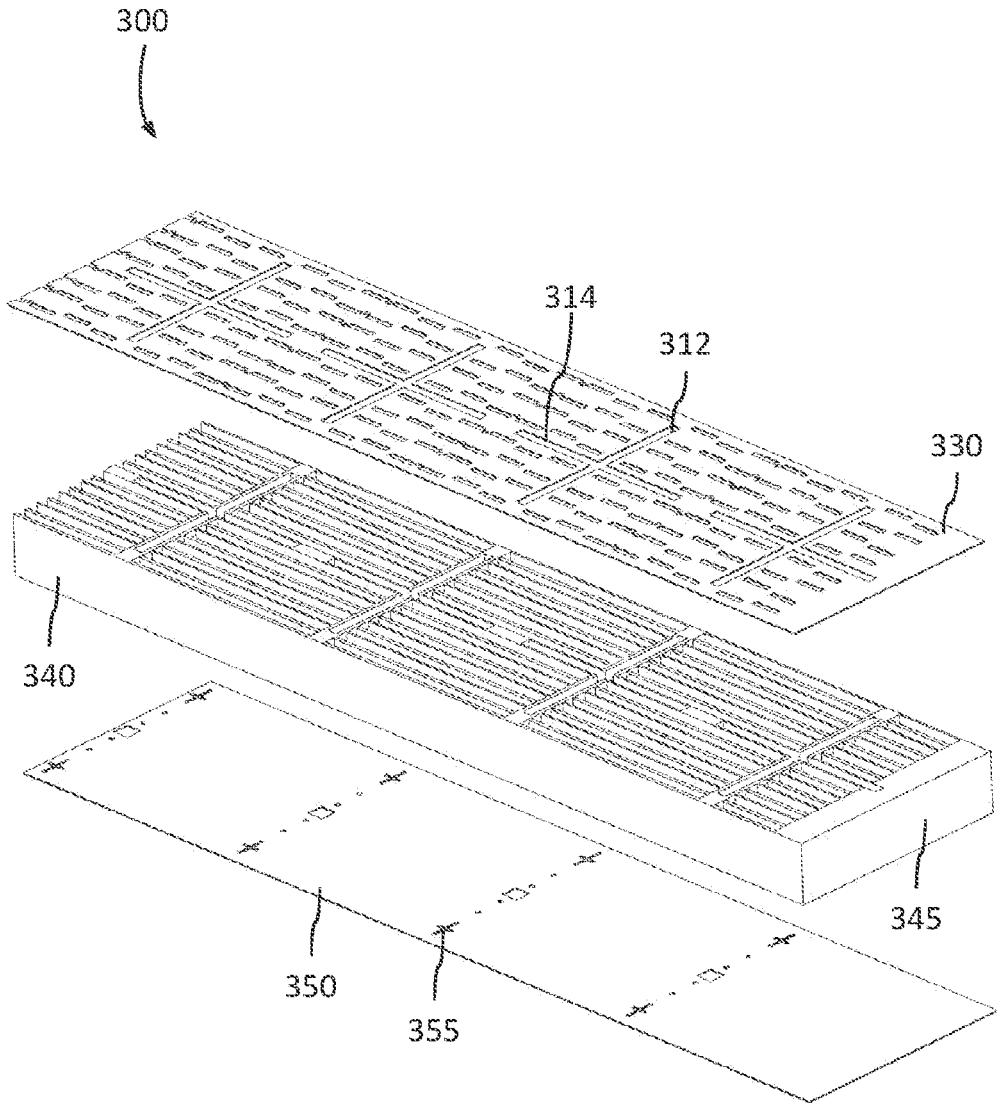
FIG. 4 is an exploded isometric view of the microwave subarray of FIG. 3.

FIG. 4 is an exploded view of microwave subarray 300 of FIG. 3. Microwave subarray 300 comprises top face sheet 330, side sheet 340, end sheet 345, and bottom face sheet 350. Bottom face sheet 350 covers the bottom of the L-band cavities and comprises slots 355 for X-band feeds.

Microwave subarray 300 comprises L-band H-polarization and V-polarization slots 312 and 314, respectively. Microwave subarray comprises X-band waveguides, such as waveguide 320-1. In some embodiments, such as the embodiment illustrated in FIG. 4, waveguide 320-1 is a ridged waveguide.

Figure 5:
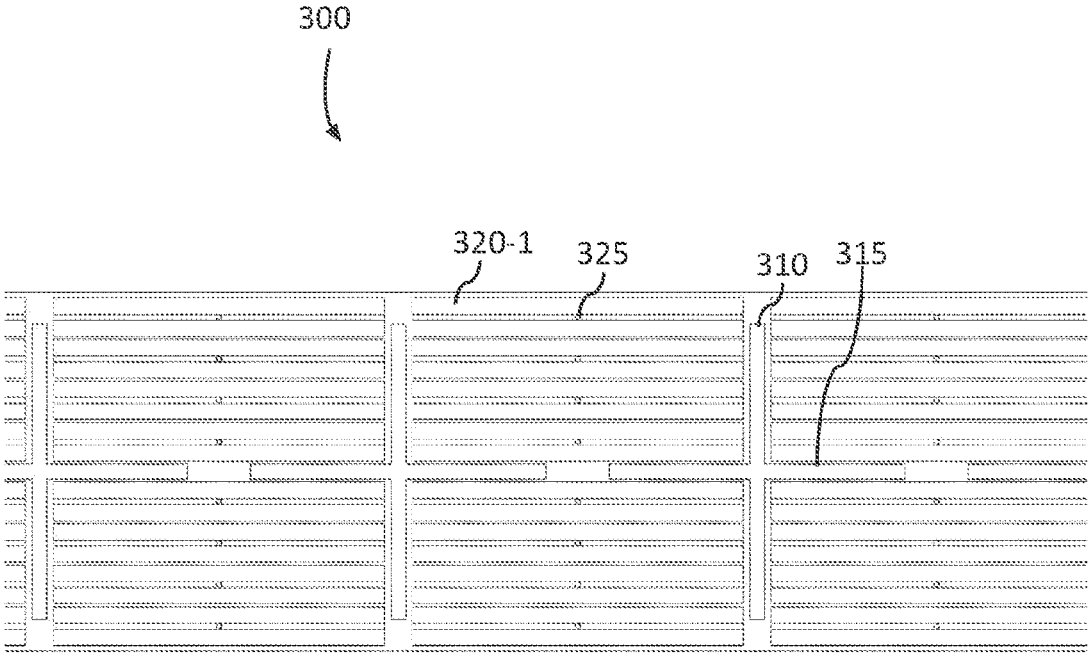
FIG. 5 is a close-up of a front plan view of the microwave subarray of FIG. 3 with a top face sheet removed.

FIG. 5 is a close-up of a plan view of microwave subarray 300 of FIG. 3 with top face sheet 330 removed. Microwave subarray 300 comprises L-band H-polarization and V-polarization slots 312 and 314, respectively. Microwave subarray comprises X-band waveguides, such as ridged waveguide 320-1. Microwave subarray 300 further comprises a plurality of X-band feeds, such as X-band feed 325. X-band feed 325 is described in more detail with reference to FIG. 8.

FIG. 6 is an isometric view of a close-up of microwave subarray 300 of FIG. 3 with side sheet 340 removed to show the L-band cavities.

The dimensions of L-band cavity 610 is frequency dependent. The depth of L-band cavity 610 is selected to provide high radiation efficiency while maintaining compact size. Similarly, the dimensions of the X-band waveguides, such as X-band waveguide 320-1, determine, at least in part, the resonant frequency and the bandwidth. X-band waveguide 320-1 comprises ridge 620.

Figure 7:
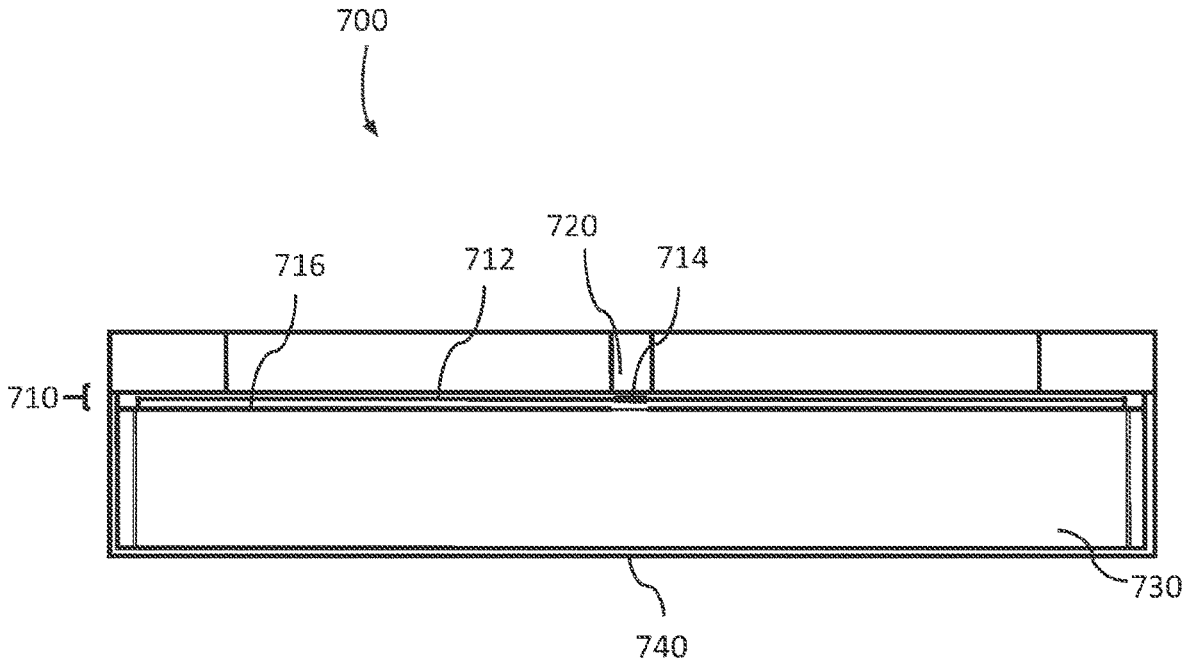
FIG. 7 is a cross-sectional view of an L-Band radiating element illustrating an L-band feed network.

FIG. 7 is a cross-section of L-Band radiating element 700 illustrating L-band feed network 710. L-band radiating element 700 comprises L-band slot 720, cavity 730, and reflector 740. L-band feed network 710 comprises stripline 712, probe 714, and ground plane 716.

L-band feed network 710 comprises a matching network (not shown in FIG. 7) embedded in stripline 712 to facilitate matching of impedance across the bandwidth.

L-band slot 720 comprises two probes, 180° out of phase with each other. The locations of the two probes in slot 720 are selected to achieve a desired radiation efficiency. Hi-polarization and V-polarization L-band slots can be fed independently. H and V polarized pulses can be transmitted at the same time.

Stripline 712 ends with probe 714 across slot 720, the probe operable to excite a field in slot 720.

L-band feed network 710 can comprise a shield (not shown in FIG. 7) to suppress cross-polarization. In an example implementation. L-band feed network is configured to suppress cross-polarization by 60 dB.

Figure 8:
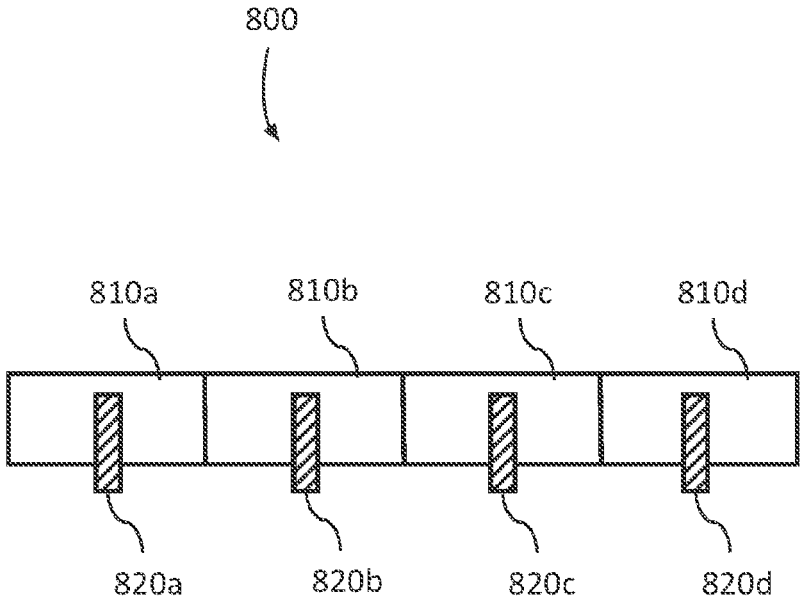
FIG. 8 is a cross-sectional view of an X-band radiating element illustrating an X-band feed network.

FIG. 8 is a cross-section of X-band radiating element 800 illustrating an X-band feed network 820. X-band radiating element 800 comprises four waveguides 810*a*. 810*b*, 810*c*, and 810*d*. Waveguides 810*a*, 810*b*. 810*c*, and 810*d* are ridged waveguides and have a ridge inside the waveguide. The dimensions of the ridge determine, at least in part, power transfer, matching and bandwidth. A benefit of a ridge in the waveguide is higher gain for equivalent radiation efficiency. Waveguides comprising a ridge can be smaller than equivalent waveguides without a ridge, and more ridged waveguides can be packed into an equivalent volume.

X-band feed network 820 comprises four coaxial cables 820*a*, 820*b*, 820*c*, and 820*d*, one for each of waveguides 810*a*. 810*b*, 810*c*, and 810*d*. Each waveguide is fed by its corresponding coaxial cable, the inner conductor of the cable (not shown in FIG. 8) passing through an aperture in the ridge to make contact with the top wall of the waveguide.

The feed coaxial cable is communicatively coupled to feed the radiating slots with the amplitude and phase signals required to create directional beams, and to perform beam scanning. In the example shown in FIG. 8, two adjacent coaxial cables are 180° out of phase.

Figure 9:
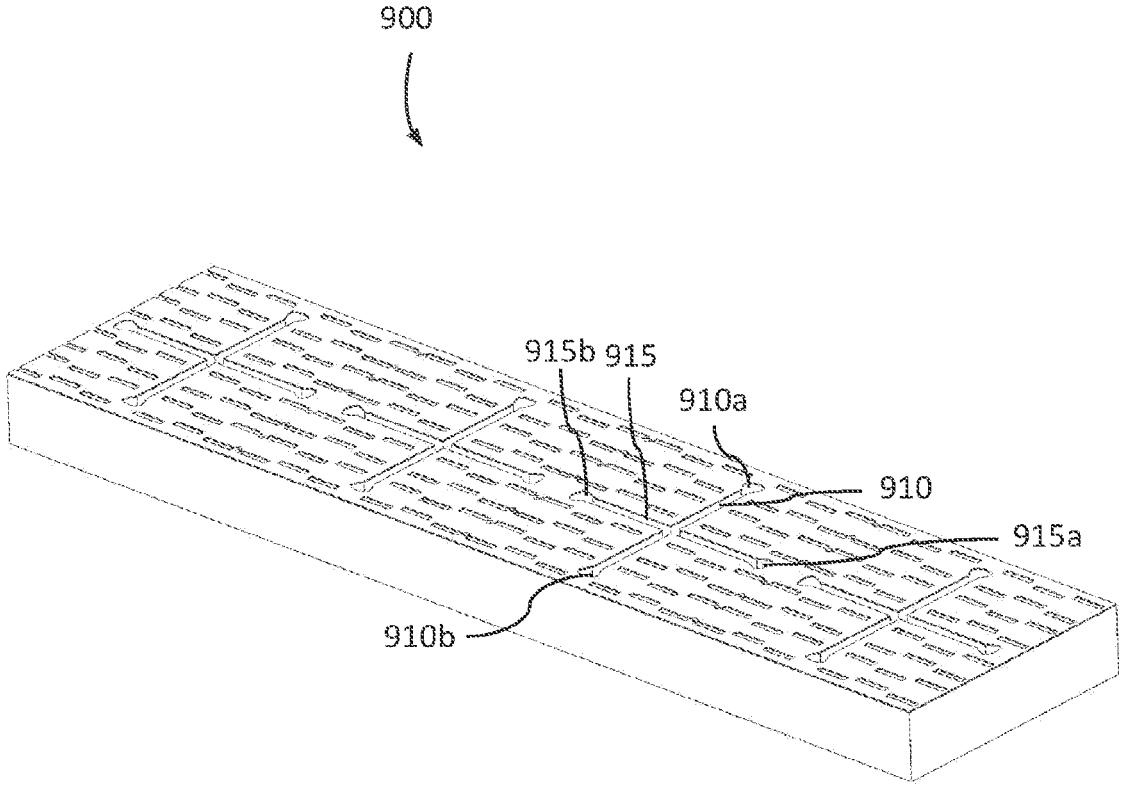
FIG. 9 is an isometric view of a microwave subarray of an efficient planar phase array antenna assembly, according to at least a second illustrated embodiment.

FIG. 9 is an isometric view of microwave subarray 900 of a second embodiment of an efficient planar phase array antenna assembly. Microwave subarray 900 comprises pairs of crossed L-band slots, such as slots 910 and 915, for H-polarization and V-polarization, respectively. In plan view, in FIG. 2 through FIG. 7, the L-band slots (such as slots 310 and 315) have a rectangular shape. In the embodiment shown in FIG. 9, slots 910 and 915 have rounded ends 910*a* and 910*b*, and 915*a* and 915*b*, respectively.

While FIG. 9 shows rounded ends, other suitable shaping can be used for the slot ends. Moreover, a portion, or the entire length, of each slot can be shaped or tapered, for example by providing a linear or exponential tapering of each slot from the middle towards each end. A benefit of shaped slots is improved tuning of resonant frequency and an increase in bandwidth.

A similar benefit can be achieved by flaring the vertical walls of the L-band slot. The cross-sectional profile of an L-band slot can be shaped to achieve a desired resonant frequency and bandwidth. In one implementation, the sides of the L-band slot are vertical. In another implementation, the sides of the L-band slot are tapered from the top of the slot to the bottom of the slot in a linear fashion. In yet another implementation, the sides of the L-band slot are tapered from the top of the slot to the bottom of the slot according to a portion of an exponential curve. In other implementations, other suitable tapering can be used.

In some implementations, shaping of the slot and its cross-sectional profile are combined to achieve a desired frequency and bandwidth.

L-band slots can be partially or fully filled with a material, for example a low-loss dielectric, to modulate the electrical length of the slot to achieve a desired resonant frequency without changing the physical length of the slot.

Figure 10:
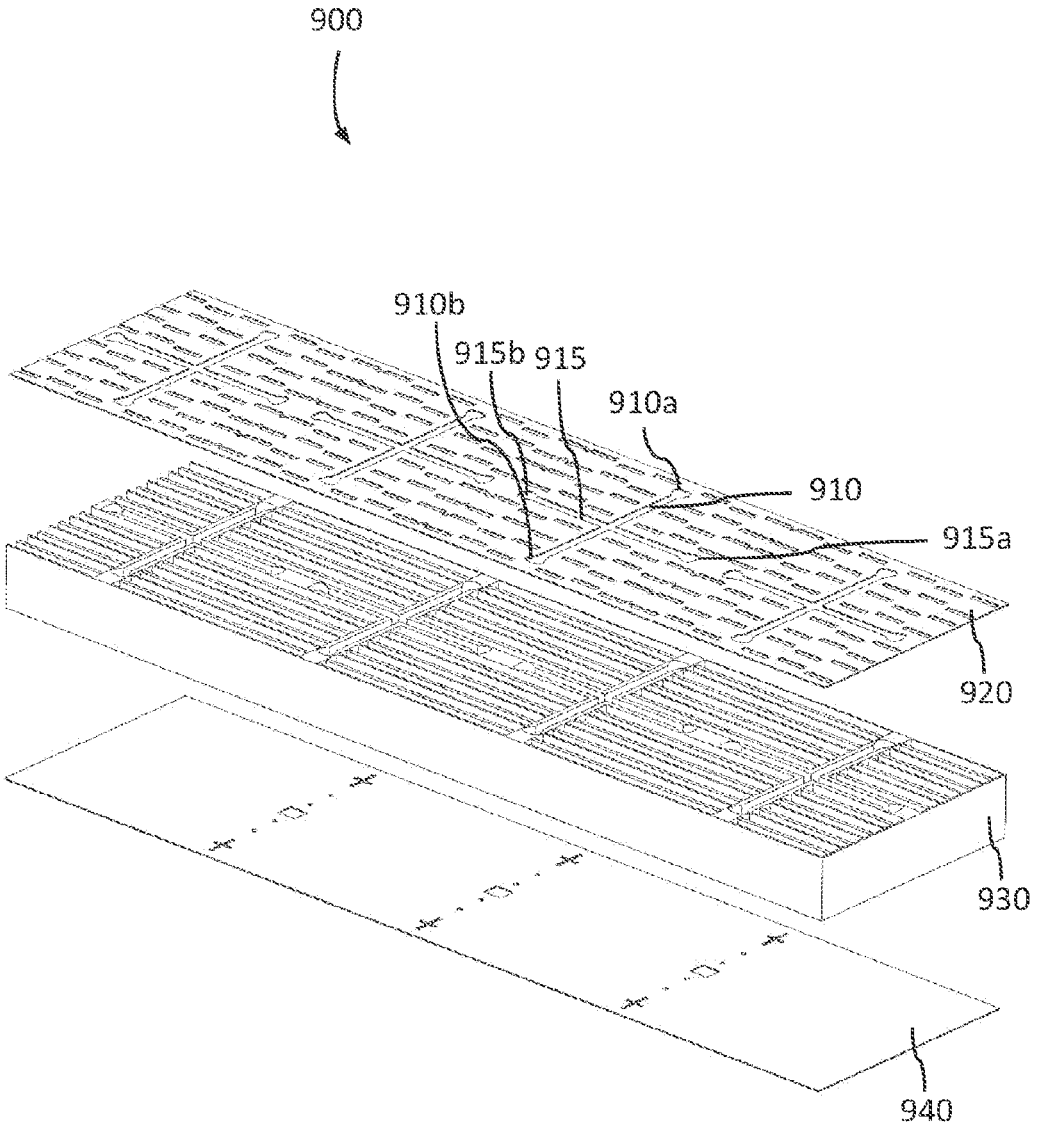
FIG. 10 is an exploded isometric view of the microwave subarray of FIG. 9.

FIG. 10 is an exploded view of the microwave subarray of FIG. 9.

Figure 11:
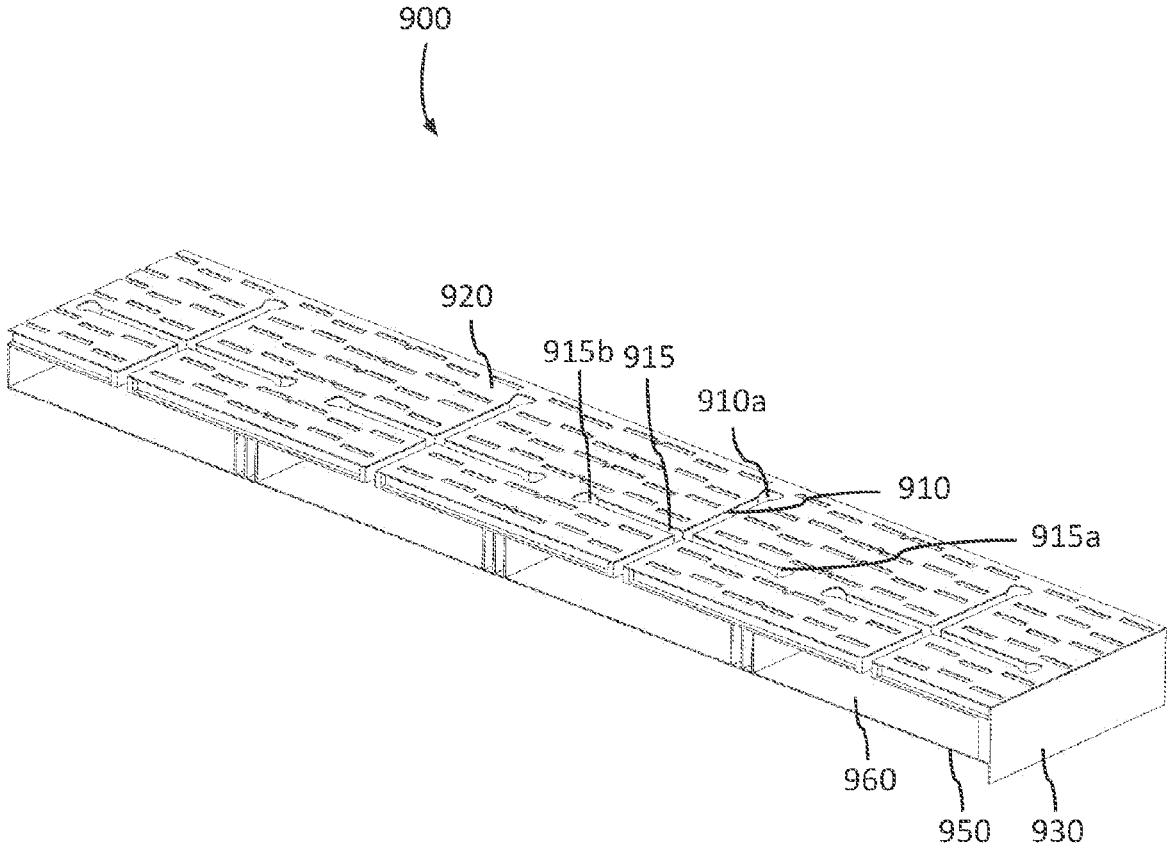
FIG. 11 is an isometric view of a close-up of the microwave subarray of FIG. 9 with a side removed to show the L-band cavity.

FIG. 11 is an isometric view of a close-up of the microwave subarray of FIG. 9 with the side removed to show the L-band cavity.

Figure 12:
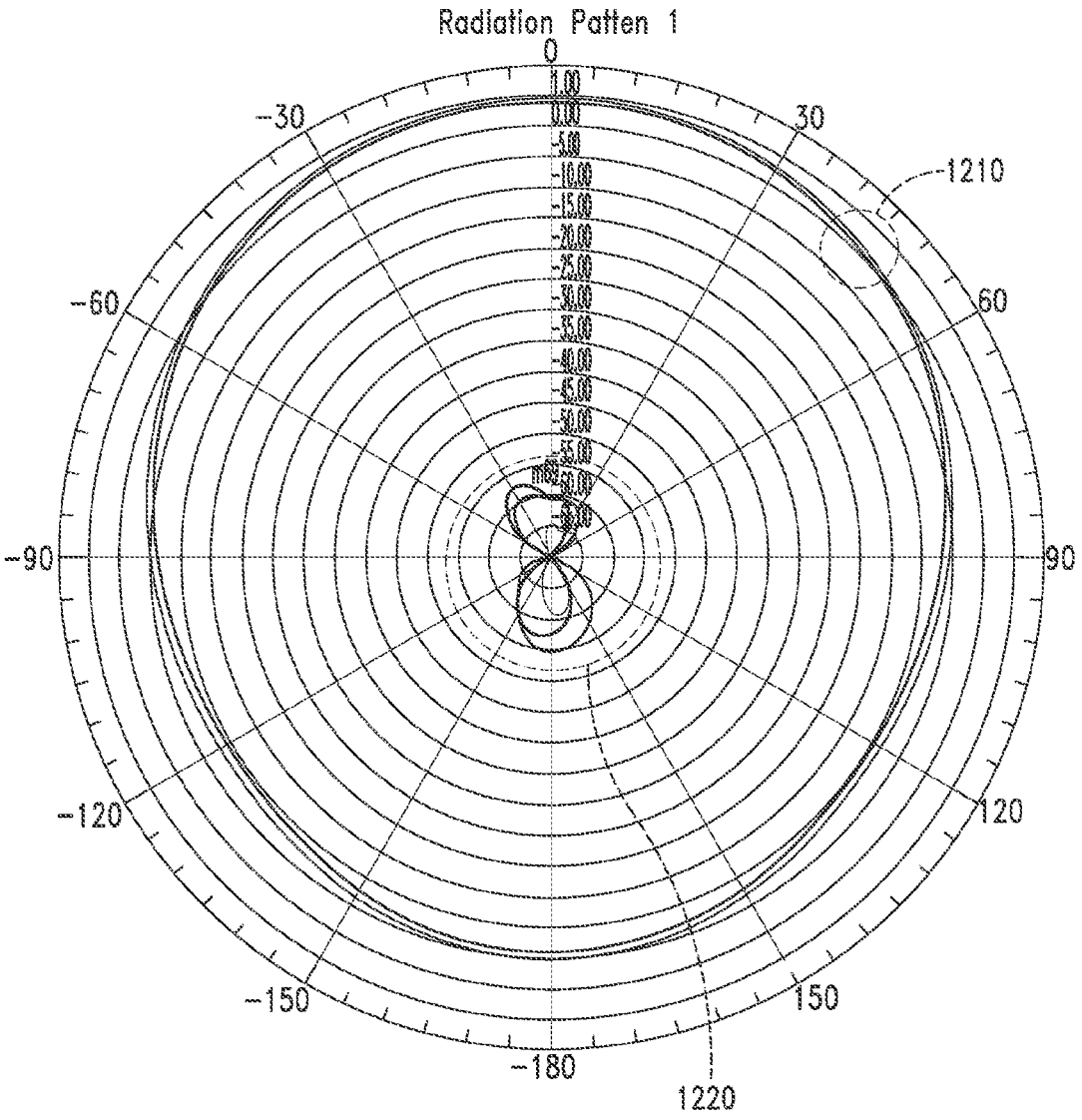
FIG. 12 is a polar plot showing a gain for an L-band radiating element of the efficient planar phase array antenna assembly of FIG. 9.

FIG. 12 is a polar plot showing the gain for an L-band radiating element of the efficient planar phase array antenna assembly of FIG. 9. In the example shown, a co-polarization to cross-polarization isolation ratio of at least 60 dB is achieved for across the range of elevation angles. Circle 1210 indicates the co-polarization gain graphs for three frequencies. Circle 1220 indicates the cross-polarization gain graphs for the same three frequencies.

Figure 13:
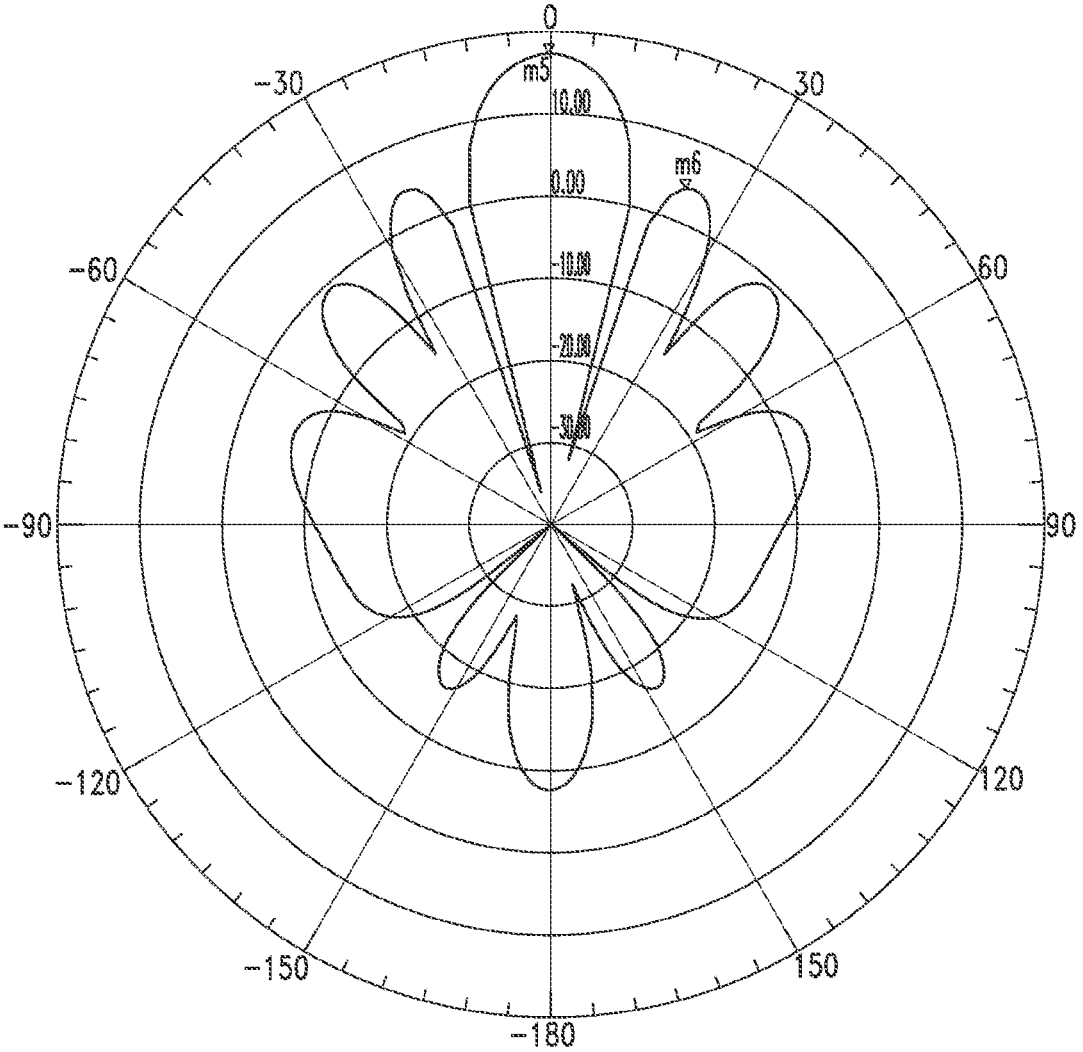
FIG. 13 is a polar plot showing a gain for an X-band radiating element of the efficient planar phase array antenna assembly of FIG. 9.

FIG. 13 is a polar plot showing the gain for an X-band radiating element of the efficient planar phase array antenna assembly of FIG. 9. In the example shown, a peak gain of at least 18 dB was achieved.

Figure 14:
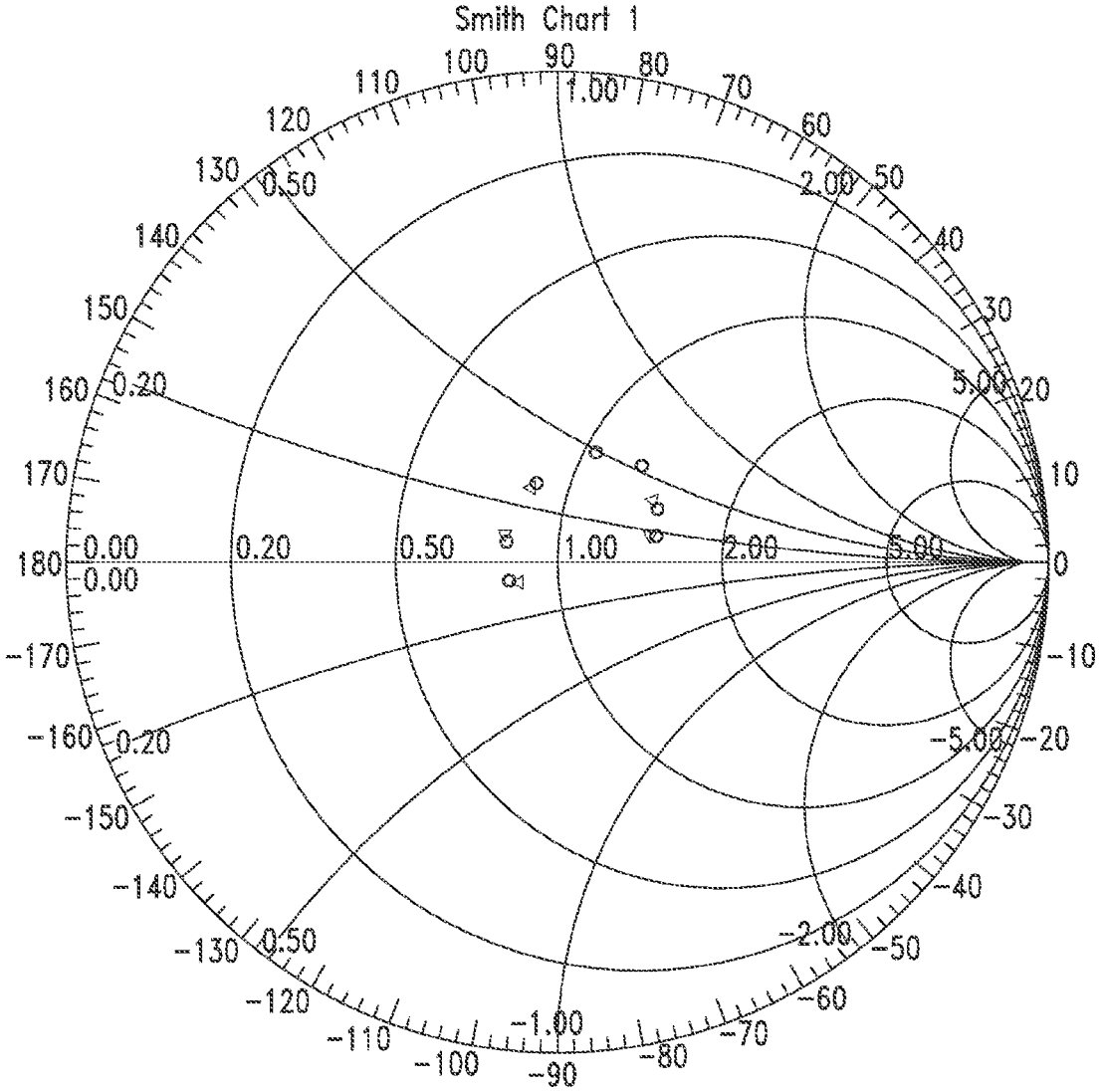
FIG. 14 is an impedance Smith chart for an L-band radiating element of the efficient planar phase array antenna assembly of FIG. 9.

FIG. 14 is an impedance Smith chart for an L-band radiating element of the efficient planar phase array antenna assembly of FIG. 9.

Benefits of the antenna technology described above include greater mass efficiency and greater radiating efficiency. Simulations have demonstrated that a radiation efficiency of over 80% can be achieved across the frequency band for X-band and L-band radiating elements, including all losses.

Having the radiating elements of the antenna be self-supporting makes the design mass efficient. No additional structural mass is needed. All the metal in the antenna performs two functions for the antenna—firstly to provide the slots and cavities for the radiating elements, and secondly to provide the structural integrity. Since the antenna can be constructed entirely from metal, there are no dielectric materials contributing to losses in the antenna, and the radiating efficiency of the antenna is high. The only losses are surface metal losses.

The above description of illustrated embodiments, including what is described in the Abstract, is not intended to be exhaustive or to limit the various embodiments to the precise forms disclosed. Although specific embodiments of and examples are described herein for illustrative purposes, various equivalent modifications can be made without departing from the spirit and scope of the disclosure, as will be recognized by those skilled in the relevant art. The teachings provided herein of the various embodiments can be applied to other imaging systems, not necessarily the exemplary satellite imaging systems generally described above.

While the foregoing description refers, for the most part, to satellite platforms for SAR and optical sensors, remotely sensed imagery can be acquired using airborne sensors including, but not limited to, aircraft and drones. The technology described in this disclosure can be applied to imagery acquired from sensors on spaceborne and airborne platforms.

The various embodiments described above can be combined to provide further embodiments. U.S. Provisional Patent Application Ser. No. 62/137,934, filed Mar. 25, 2015; U.S. Provisional Patent Application Ser. No. 62/180,421, filed Jun. 16, 2015 and entitled "EFFICIENT PLANAR PHASED ARRAY ANTENNA ASSEMBLY"; U.S. Provisional Patent Application Ser. No. 62/180,449, filed Jun. 16, 2015 and entitled "SYSTEMS AND METHODS FOR ENHANCING SYNTHETIC APERTURE RADAR IMAGERY"; and U.S. Provisional Patent Application Ser. No. 62/180,440, filed Jun. 16, 2015 and entitled "SYSTEMS AND METHODS FOR REMOTE SENSING OF THE EARTH FROM SPACE", are each incorporated herein by reference, in their entirety. Aspects of the embodiments can be modified, if necessary, to employ systems, circuits and concepts of the various patents, applications and publications to provide yet further embodiments.

For instance, the foregoing detailed description has set forth various embodiments of the devices and/or processes via the use of block diagrams, schematics, and examples. Insofar as such block diagrams, schematics, and examples contain one or more functions and/or operations, it will be understood by those skilled in the art that each function and/or operation within such block diagrams, flowcharts, or examples can be implemented, individually and/or collectively, by a wide range of hardware, software, firmware, or virtually any combination thereof. In one embodiment, the present subject matter may be implemented via Application Specific Integrated Circuits (ASICs). However, those skilled in the art will recognize that the embodiments disclosed herein, in whole or in part, can be equivalently implemented in standard integrated circuits, as one or more computer programs running on one or more computers (e.g., as one or more programs running on one or more computer systems), as one or more programs running on one or more controllers (e.g., microcontrollers) as one or more programs running on one or more processors (e.g., microprocessors), as firmware, or as virtually any combination thereof, and that designing the circuitry and/or writing the code for the software and or firmware would be well within the skill of one of ordinary skill in the art in light of this disclosure.

In addition, those skilled in the art will appreciate that the mechanisms of taught herein are capable of being distributed as a program product in a variety of forms, and that an illustrative embodiment applies equally regardless of the particular type of signal hearing media used to actually carry out the distribution. Examples of signal hearing media include, but are not limited to, the following: recordable type media such as floppy disks, hard disk drives, CD ROMs, digital tape, and computer memory; and transmission type media such as digital and analog communication links using TDM or IP based communication links (e.g., packet links).

These and other changes can be made in light of the above-detailed description. In general, in the following claims, the terms used should not be construed to limit the invention to the specific embodiments disclosed in the specification and the claims, but should be construed to include all possible embodiments along with the full scope of equivalents to which such claims are entitled. Accordingly, the invention is not limited by the disclosure.

What is claimed is:

1. A planar phased array antenna assembly comprising:

a first face sheet, the first face sheet comprising a first plurality of radiating slots for a first frequency band and a second plurality of radiating slots for a second frequency band;

a second face sheet;

a structure interposed between the first face sheet and the second face sheet, the structure comprising a third plurality of radiating elements at the first frequency band and a fourth plurality of radiating elements at the second frequency band, the structure further comprising a first feed network for the third plurality of radiating elements and a second feed network for the fourth plurality of radiating elements; and a third face sheet wherein the second face sheet is interposed between the structure and the third face sheet.

2. The planar phased array antenna assembly of claim 1 wherein the assembly is structurally self-supporting.

3. The planar phased array antenna assembly of claim 2 wherein substantially the entire assembly consists of radiating elements and feed networks.

4. The planar phased array antenna assembly of claim 1 wherein the first face sheet, the second face sheet, the third face sheet, and the structure each comprise machined aluminium.

5. The planar phased array antenna assembly of claim 1 wherein each of the third plurality of radiating elements comprises a folded cavity coupled to at least one of the first plurality of radiating slots.

6. The planar phased array antenna assembly of claim 1 wherein each of the fourth plurality of radiating elements comprises at least one waveguide coupled to at least one of the second plurality of radiating slots, and the third face sheet comprises waveguide terminations.

7. The planar phased array antenna assembly of claim 6 wherein each of the at least one waveguide is a ridged waveguide.

8. The planar phased array antenna assembly of claim 1 wherein the first frequency band is L-band and the second frequency band is X-band.

9. The planar phased array antenna assembly of claim 1 wherein the first feed network comprises at least one stripline, and at least one probe coupled to each of the third plurality of radiating elements.

10. The planar phased array antenna assembly of claim 1 wherein the second feed network comprises at least one coaxial cable coupled to each of the fourth plurality of radiating elements.

11. The planar phased array antenna assembly of claim 1 wherein the first plurality of radiating slots comprise a plurality of crossed slots, the crossed slots operable to radiate horizontally polarized and vertically polarized microwaves.

12. The planar phased array antenna assembly of claim 11 wherein the plurality of crossed slots are flared in at least one of an in-plane and a through-plane orientation.

13. The planar phased array antenna assembly of claim 5 wherein the folded cavity is at least partially filled with dielectric material.

14. The planar phased array antenna assembly of claim 2 wherein the first, the second and the third face sheets and the structure interposed between the first and the second face sheets comprise a sole support structure of the planar phased array antenna assembly that self supports the planar phased array antenna assembly without any additional structure.

15. The planar phase array antenna assembly of claim 1 wherein the first frequency band is lower than the second frequency band.

16. The planar phase array antenna assembly of claim 15 wherein the first face sheet further comprises a fifth plurality of radiating slots for a third frequency band, the structure further comprises a sixth plurality of radiating elements at a third frequency band, the third frequency band higher than the first frequency band and lower than the second frequency band.

17. A synthetic aperture radar (SAR) antenna comprising a planar phased array antenna assembly, the planar phased array antenna assembly comprising:

a first face sheet, the first face sheet comprising a first plurality of radiating slots for a first frequency band and a second plurality of radiating slots for a second frequency band;

a second face sheet;

a structure interposed between the first face sheet and the second face sheet, the structure comprising a third plurality of radiating elements at the first frequency band and a fourth plurality of radiating elements at the second frequency band, the structure further comprising a first feed network for the third plurality of radiating elements and a second feed network for the fourth plurality of radiating elements; and a third face sheet wherein the second face sheet is interposed between the structure and the third face sheet.

18. The synthetic aperture radar (SAR) antenna of claim 17 wherein the first frequency band is lower than the second frequency band.

19. The synthetic aperture radar (SAR) antenna of claim 17 wherein the planar phased array antenna assembly is structurally self-supporting.

20. The synthetic aperture radar (SAR) antenna of claim 19 wherein the first, the second and the third face sheets and the structure interposed between the first and the second face sheets comprise a sole support structure of the planar phased array antenna assembly that self supports the planar phased array antenna assembly without any additional structure.

21. A synthetic aperture radar (SAR) comprising a planar phased array antenna assembly, the planar phased array antenna assembly comprising:

a first face sheet, the first face sheet comprising a first plurality of radiating slots for a first frequency band and a second plurality of radiating slots for a second frequency band;

a second face sheet;

a structure interposed between the first face sheet and the second face sheet, the structure comprising a third plurality of radiating elements at the first frequency band and a fourth plurality of radiating elements at the second frequency band, the structure further comprising a first feed network for the third plurality of radiating elements and a second feed network for the fourth plurality of radiating elements; and a third face sheet wherein the second face sheet is interposed between the structure and the third face sheet.

22. The synthetic aperture radar (SAR) of claim 21 wherein the planar phased array antenna assembly is structurally self-supporting.

23. The synthetic aperture radar (SAR) of claim 22 wherein the first, the second and the third face sheets and the structure interposed between the first and the second face sheets comprise a sole support structure of the planar phased array antenna assembly that self supports the planar phased array antenna assembly without any additional structure.

24. The synthetic aperture radar (SAR) of claim 21 wherein the first frequency band is lower than the second frequency band.

* * * * *